US006889012B2

(12) United States Patent
Morimoto

(10) Patent No.: US 6,889,012 B2
(45) Date of Patent: May 3, 2005

(54) IMAGE FORMING APPARATUS FOR MONOCHROMATIC AND COLOR IMAGE FORMATION

(75) Inventor: Kenichi Morimoto, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 57 days.

(21) Appl. No.: 10/167,636

(22) Filed: Jun. 12, 2002

(65) Prior Publication Data

US 2002/0191978 A1 Dec. 19, 2002

(30) Foreign Application Priority Data

Jun. 14, 2001 (JP) ..... P2001-180534

(51) Int. Cl.[7] ..... G03G 15/00
(52) U.S. Cl. ..... 399/2; 347/3
(58) Field of Search ..... 399/2, 6, 45, 401, 399/364, 178, 179, 194, 298, 299, 306, 309; 347/2, 3

(56) References Cited

U.S. PATENT DOCUMENTS

| | | | | | |
|---|---|---|---|---|---|
| 4,789,879 | A | * | 12/1988 | Murakami | 399/196 |
| 5,296,939 | A | | 3/1994 | Suzuki | 358/453 |
| 5,373,350 | A | | 12/1994 | Taylor et al. | |
| 5,398,101 | A | * | 3/1995 | Takada et al. | 399/43 |
| 5,570,451 | A | | 10/1996 | Sakaizawa et al. | |
| 5,729,785 | A | | 3/1998 | Sakaizawa et al. | 399/2 |
| 5,734,390 | A | * | 3/1998 | Sakaizawa et al. | 347/2 |
| 5,751,299 | A | * | 5/1998 | Denton et al. | 347/2 |
| 5,760,928 | A | * | 6/1998 | Motoyama et al. | 358/501 |
| 5,781,823 | A | | 7/1998 | Isobe et al. | |
| 5,790,915 | A | * | 8/1998 | Arcaro et al. | 399/2 |
| 6,078,346 | A | * | 6/2000 | Isobe et al. | 347/218 |
| 6,256,463 | B1 | * | 7/2001 | Manzer et al. | 399/76 |
| 6,582,039 | B2 | * | 6/2003 | Johnson et al. | 347/3 |

FOREIGN PATENT DOCUMENTS

| | | | | |
|---|---|---|---|---|
| EP | 0 537 671 | | 10/1992 | |
| EP | 0 796 739 | | 2/1997 | |
| JP | 07-117282 | | 5/1995 | |
| JP | 8-95463 | | 4/1996 | |
| JP | 08328325 | A * | 12/1996 | G03G/15/00 |
| JP | 10-10819 | | 1/1998 | |
| JP | 10171202 | A * | 6/1998 | G03G/15/01 |
| JP | 2002049186 | A * | 2/2002 | G03G/15/00 |

* cited by examiner

*Primary Examiner*—Robert Beatty
(74) *Attorney, Agent, or Firm*—Renner, Otto, Boisselle & Sklar, LLP

(57) ABSTRACT

An image forming apparatus is provided which includes a first image forming section for performing image formation based on monochromatic image data, and a second image forming section for performing image formation based on color image data. The first and second image forming sections are arranged in mutually different positions along a path for conveying recording paper. The image forming apparatus further includes an image processing section for outputting monochromatic image data and color image data, which have undergone image processing, to the first image forming section and the second image forming section respectively, at individual timings for forming images an either one or both sides of the recording paper.

10 Claims, 23 Drawing Sheets

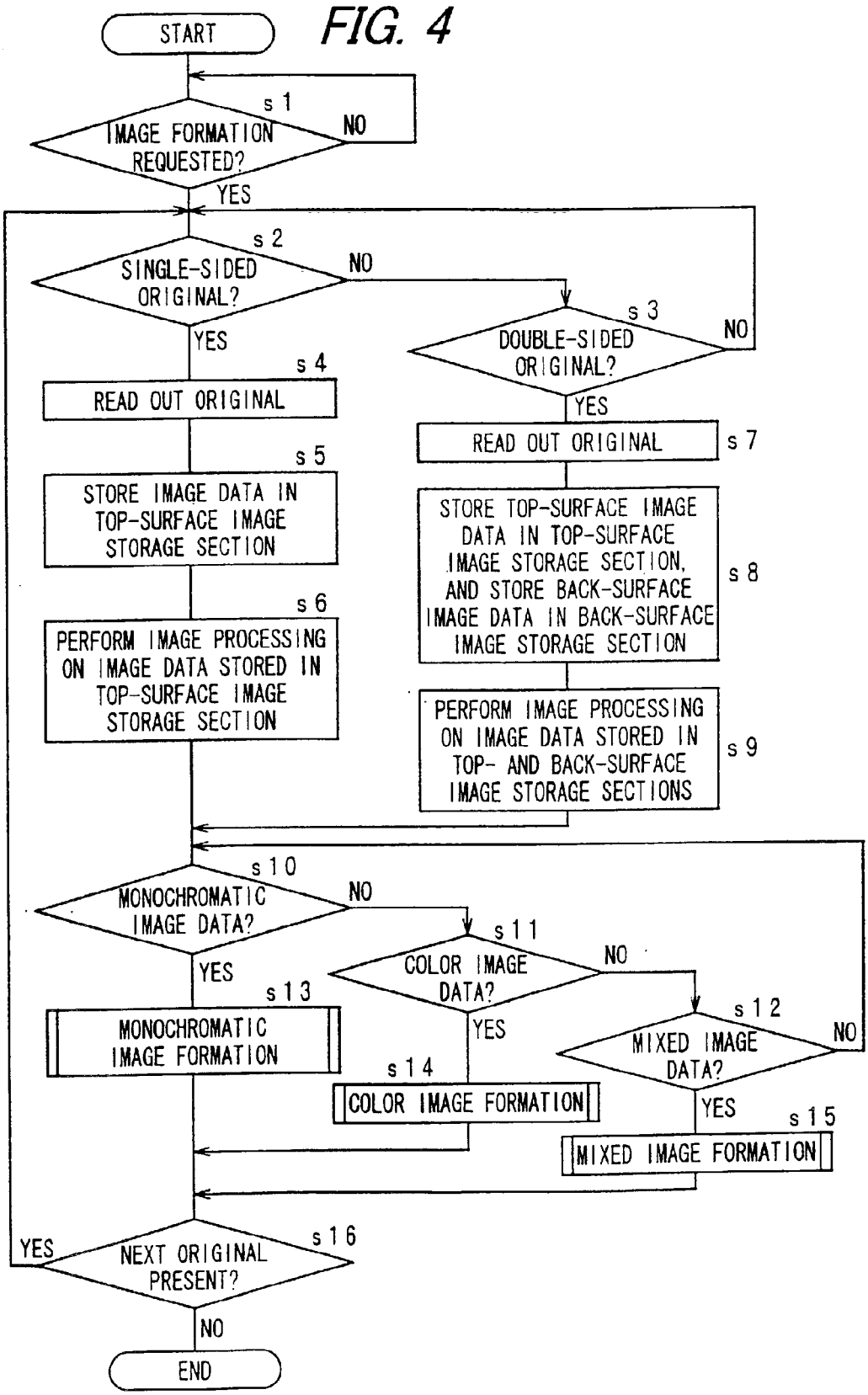
FIG. 4
START
s 1
IMAGE FORMATION REQUESTED?
NO
YES
s 2
SINGLE-SIDED ORIGINAL?
NO
YES
s 3
DOUBLE-SIDED ORIGINAL?
NO
YES
s 4
READ OUT ORIGINAL
s 5
STORE IMAGE DATA IN TOP-SURFACE IMAGE STORAGE SECTION
s 6
PERFORM IMAGE PROCESSING ON IMAGE DATA STORED IN TOP-SURFACE IMAGE STORAGE SECTION
READ OUT ORIGINAL
s 7
STORE TOP-SURFACE IMAGE DATA IN TOP-SURFACE IMAGE STORAGE SECTION, AND STORE BACK-SURFACE IMAGE DATA IN BACK-SURFACE IMAGE STORAGE SECTION
s 8
PERFORM IMAGE PROCESSING ON IMAGE DATA STORED IN TOP- AND BACK-SURFACE IMAGE STORAGE SECTIONS
s 9
s 10
MONOCHROMATIC IMAGE DATA?
NO
YES
s 11
COLOR IMAGE DATA?
NO
YES
s 12
MIXED IMAGE DATA?
NO
YES
s 13
MONOCHROMATIC IMAGE FORMATION
s 14
COLOR IMAGE FORMATION
s 15
MIXED IMAGE FORMATION
s 16
NEXT ORIGINAL PRESENT?
YES
NO
END

FIG. 23

T1

| RECORDING PAPER SIZE | NUMBER OF PASSAGE OF FIXATION UNIT | |
|---|---|---|
| | 1 | 2 |
| A3 | | |
| B4 | | |
| A4 | | |
| B5 | | |
| A5 | | |
| B6 | | |

IMAGE FORMING APPARATUS FOR MONOCHROMATIC AND COLOR IMAGE FORMATION

BACKGROUND OF THE INVENTION

1. Field of the Invention

The present invention relates to an image forming apparatus employing two different image forming sections in combination, of which one is designed for performing monochromatic image formation based on a method using a developer, such as an electrophotographic system, and the other is designed for performing color image formation based on a method using ink, such as an ink-jet system.

2. Description of the Related Art

Conventionally, as image forming methods for forming a color image, there have been known a method using a developer, such as an electrophotographic system, and a method using ink, such as an ink-jet system. These two conventional systems each have advantage and disadvantage. Regarding the electrophotographic system, the positive side is that speeding-up of image formation can be achieved by forcibly fixing a developer onto a paper sheet through application of heat and pressure, and that the running cost can be reduced by using a relatively inexpensive developer. The negative side is that, since a developer in use, which is obtained by mixing pigment or dye into powder of thermoplastic resin, is transferred onto recording paper and is then fixed thereon by heating, a change of hue is likely to occur due to the influence of the transparency of the resin powder and to a temperature rise occurring during the fixation, resulting in poor color reproducibility. Likewise, regarding the ink-jet system, the positive side is, that image formation is achieved by using highly-transparent liquid ink without performing heating at high temperature, resulting in excellent color reproducibility. The negative side is that much time needs to be spent in drying the ink and thus speeding-up of operation cannot be achieved, and that the running cost is sharply increased because of the use of relatively expensive ink.

Moreover, in general, as data on color images to be formed onto recording paper, rather than full-color image data, partial-color image data is used more frequently that corresponds to a seal, illustration, or graph represented in a single color or a plurality of colors, which is included in part of text images of a document or the like.

With consideration given to the characteristics of each of the above-described image forming methods and to color image usage conditions, there has conventionally been proposed an image forming apparatus employing two different image forming sections in combination, of which one is designed for performing image formation based on a method using a developer, such as an electrophotographic system, and the other is designed for performing image formation based on a method using ink, such as an ink-jet system. In this construction, monochromatic image formation is performed in the developer-system image forming section, whereas color image formation is performed in the ink-system image forming section.

For example, Japanese Unexamined Patent Publication JP-A 8-95463 (1996) discloses an image forming apparatus which is so designed that, after completion of electrophotographic system-based image formation, ink-jet system-based image formation is performed. This construction is characterized in that means for changing the speed of conveyance of recording paper, or means for cooling recording paper is separately provided for each of the following individual cases: a case of performing image formation based solely on the electrophotographic system; a case of performing image formation based on both of the electrophotographic system and the ink-jet system; and a case of performing image formation based solely on the ink-jet system. In this arrangement, the temperature of the recording paper, which has passed through a fixation unit incorporated in the electrophotographic-system image forming section, can be kept within a predetermined range at all times, whereby making it possible to prevent deterioration in image quality due to ink blot produced during the ink-jet-system image formation.

However, in the conventional image forming apparatus employing a developer-system image forming section and an ink-system image forming section in combination, it has proved impossible to make sufficiently short the paper conveying path running through the developer-system image forming section and the ink-system image forming section, in consideration of the difference in image forming speed between the developer system and the ink system. Consequently, the apparatus as a whole cannot be kept satisfactorily compact.

That is, in general, the developer system and the ink system differ from each other in paper conveyance speed for image formation. Thus, in a case where the distance between an upstream-side image forming section and a downstream-side image forming section is set to be shorter than the length of recording paper, before the rear end of the recording paper passes through the upstream-side image forming section, the front end of the recording paper reaches the downstream-side image forming section. As a result, the recording paper suffers from slack or is pulled forward and backward, causing paper jamming or tearing.

Moreover, in the construction in which the distance between the upstream-side image forming section and the downstream-side image forming section is set to be shorter than the length of recording paper, assume that the ink-system image forming section arranged downstream of the developer-system image forming section is provided with an ink head which is moved reciprocally in a main scanning direction orthogonal to the paper conveying direction, and that conveyance of recording paper is brought to a stop during the movement of the ink head in the main scanning direction. In this case, in the upstream-side developer-system image forming section, even during the interval when no image formation is being performed, it is impossible to let recording paper to pass through, at uniform speed, the fixation section maintained at a predetermined high temperature. This leads to unevenness in the degree of influence exerted upon the recording paper as a result of heating and pressurizing performed by the fixation section, giving rise to lack of uniformity in the image forming condition.

By contrast, in the construction disclosed in Japanese Unexamined Patent Publication JP-A 10-10819 (1998), arranged on the downstream side of the electrophotographic-system image forming section along the paper conveying direction is the ink-jet-system image forming section, and the conveying path extending from a fixation roller included in the electrophotographic-system image forming section to an ink jet head included in the ink-jet-system image forming section is made longer in length than recording paper. In this construction, the paper conveying path is so long that the apparatus as a whole needs to be made unduly large.

Moreover, the conventional image forming apparatus employing a developer-system image forming section and an ink-system image forming section in combination pays no regard to the case of forming images on both surfaces of recording paper, and thus the following problem is posed. In each of the case of forming any of a monochromatic image, a color image, and a mixed image obtained by combining monochromatic and color images, on only one surface of recording paper, and the case of forming any of the above-mentioned images on both surfaces of the recording paper, it is impossible to supply image data to each of the image forming sections in a manner suited for the conveying path which is made shortest in length so as to achieve the highest image formation speed. This leads to poor color reproducibility.

Further, the developer-system image forming section is typically provided with a fixation unit for applying heat and pressure to recording paper, so as to fix a developer image onto recording paper. In this case, recording paper undergoes deformation due to heating and pressurizing performed by the fixation unit. Accordingly, in order to form a mixed image, which is obtained by combining monochromatic and color images, on one surface or both surfaces of the recording paper, image formation is inevitably performed on the recording paper having been deformed due to heating and pressurizing. In this respect, since the conventional image forming apparatus pays no regard to adjustment of quantity of image data, there appears disconformity in the relative size between monochromatic and color images formed onto recording paper. This leads to poor color reproducibility.

SUMMARY OF THE INVENTION

An object of the invention is to provide an image forming apparatus which is capable of supplying image data to each image forming section, in a manner suited for a conveying path which is made shortest so as to achieve the highest image formation speed, in either of two cases: a case of forming any of a monochromatic image, a color image, and a mixed image obtained by combining monochromatic and color images, on only one surface of recording paper; and a case of forming any of the above-mentioned images on both surfaces of the recording paper and also capable of enhancing color reproducibility by ensuring conformity in the relative size between monochromatic and color images formed onto recording paper having been deformed while passing through at least one of the forming sections.

Structural features of the invention that are devised to achieve the above object will be set forth hereunder.

The invention provides an image forming apparatus comprising:

a first image forming section for performing image formation based on monochromatic image data;

a second image forming section for performing image formation based on color image data, the first and second image forming sections being arranged in mutually different positions along a path for conveying recording paper; and an image processing section for outputting monochromatic image data and color image data, which have undergone image processing, to the first image forming section and the second image forming section, respectively, at individual timings.

According to the invention, image processing on monochromatic image data and image processing on color image data can be performed by the same image processing section. This eliminates the need to provide data storage means separately for each of monochromatic image data and color image data, and thus helps simplify the structure of the image processing section. Moreover, monochromatic image data and color image data are individually outputted to the first and second image forming sections at their individual timings. Therefore, even in a case where the first and second image forming sections differ from each other in image forming method and are accordingly operated at different timings during their image forming operations, image data can be supplied from the single image processing section to each of the image forming sections at an appropriate timing. This makes it possible to supply image data at an optimal timing suited for the path for conveying recoding paper running through a plurality of image forming sections adopting different image forming methods, so that the image reproducibility is enhanced.

In the invention, it is preferable that the image processing section makes judgment on whether inputted image data is monochromatic image data or color image data, on the basis of a result of comparison between each of hue values, which is presented in inputted image data having undergone color separation, and a predetermined threshold value.

According to the invention, whether inputted image data is monochromatic image data or color image data is judged on the basis of the comparison between each of the hue values presented in the inputted image data having undergone color separation and a predetermined threshold value. In this manner, accurate and speedy judgment can be made as to whether inputted image data is monochromatic image data or color image data, which are subjected to different image processing operations. As a result, the time required for image processing operations can be shortened.

In the invention, it is preferable that, in the image processing section, comparison is made between each of the hue values presented in inputted image data having undergone color separation and a predetermined threshold value, and if at least one of the hue values is found to be equal to or greater than the predetermined threshold value, the inputted image data is judged as color image data.

According to the invention, when at least one of the hue values presented in inputted image data having undergone color separation is found to be equal to or greater than a predetermined threshold value, the inputted image data is judged as color image data. This helps reduce the time required for identifying data on color image rendered in vivid hue.

In the invention, it is preferable that, in the image processing section, when a difference between the individual hue values, presented in inputted image data having undergone color separation, is found to be equal to or smaller than a predetermined threshold value, the inputted image data is judged as monochromatic image data.

According to the invention, when a difference between the individual hue values, presented in inputted image data having undergone color separation, is found to be slight, the inputted image data is judged as monochromatic image data. This helps reduce the time required for judging whether the inputted image data is monochromatic image data or color image data.

In the invention, it is preferable that, in the image processing section, a timing with which monochromatic and color image data are outputted is determined on the basis of a timing with which recording paper is conveyed toward the first and second image forming sections, and information on how an image is formed onto the recording paper.

According to the invention, monochromatic and color image data are individually outputted from the image processing section at timings determined on the basis of the timing with which recording paper is conveyed toward each of the image forming sections to which monochromatic and color image data are supplied selectively, and information on how an image is formed onto the recording paper, for example, whether images are formed on one surface of the recording paper or both surfaces thereof. Accordingly, monochromatic and color image data can be individually outputted to each of a plurality of image forming sections at appropriate timings determined in accordance with the conveyance condition of the recording paper.

In the invention, it is preferable that the image processing section outputs monochromatic image data to the first image forming section at a timing conforming to a driving timing set for a conveyance member, which is arranged immediately in front of the first image forming section along the recording paper conveying path.

According to the invention, monochromatic image data is supplied to the first image forming section in synchronism with the timing with which recording paper is guided into the first image forming section by the conveyance member arranged immediately in front of the first image forming section. Accordingly, on the basis of the driving timing of the conveyance member existing in the first image forming section, monochromatic image data is supplied to the first image forming section at a timing suited for image forming operation to be performed on recording paper in the first image forming section.

In the invention, it is preferable that the image processing section outputs color image data to the second image forming section at a timing conforming to a driving timing set for a conveyance member, which is arranged immediately in front of or behind the second image forming section along the recording paper conveying path.

According to the invention, color image data is supplied to the second image forming section in synchronism with the timing with which recording paper is guided into the second image forming section by the conveyance member arranged immediately in front of or behind the second image forming section. Accordingly, on the basis of the driving timing of the conveyance member existing in the second image forming section, color image data is supplied to the second image forming section at a timing suited for image forming operation to be performed on recording paper in the second image forming section.

The invention further provides an image forming apparatus comprising:

a first image forming section for performing image formation based on monochromatic image data;

a second image forming section for performing image formation based on color image data, the first and second image forming sections being arranged in mutually different positions along a path for conveying recording paper; and an image processing section for successively outputting monochromatic and color image data to form a mixed image, which is obtained by combining monochromatic and color images, on both surfaces of recording paper in a following order: data on a monochromatic image to be formed on a first surface of the recording paper; data on a color image to be formed on a second surface of the recording paper; data on a monochromatic image to be formed on the second surface of the recording paper; and data on a color image to be formed on the first surface of the recording paper.

According to the invention, monochromatic and color images are formed on both surfaces of recoding paper in the following manner. At first, monochromatic image data for the first surface of the recording paper is supplied to the first image forming section. Thereafter, color image data for the second surface is supplied to the second image forming section. Subsequently, monochromatic image data for the second surface is supplied to the first image forming section. Lastly, color image data for the first surface is supplied to the second image forming section. As a result, during the interval when the recording paper is passing through the conveying path, along which the first and second image forming sections are arranged in this order, and is then passing therethrough once again after being turned upside down, monochromatic and color images are successively formed on both surfaces of the recoding paper.

In the invention, it is preferable that the image processing section successively outputs monochromatic image data in such a manner that an image is gradually formed in an order from its front-end portion to its rear-end portion, as viewed on the recording paper, for first-surface image formation in a double-sided image formation mode, whereas output monochromatic image data in such a manner that an image is gradually formed in an order from its rear-end portion to its front-end portion, for second-surface image formation in the double-sided image formation mode.

According to the invention, in the double-sided image formation mode, the order of supplying monochromatic image data to the first image forming section set for the first-surface image formation is the reverse of that set for the second-surface image formation. Accordingly, monochromatic image data for the first and second surfaces can be supplied to the first image forming section in a manner suited for the following recording-paper conveyance method adopted in the double-sided image formation mode based on monochromatic image data: after a monochromatic image is formed on the first surface of the recoding paper which passes through the second image forming section first, the recording-paper conveying direction is reversed. Thereupon, reversals of the traveling directions of both surfaces of the recording paper are completed. In this state, the recording paper passes through the first image forming section once again, during which a monochromatic image is being formed on the second surface of the recording paper.

In the invention, it is preferable that the image processing section successively outputs color image data in such a manner that an image is gradually formed in an order from its rear-end portion to its front-end portion, as viewed on the recording paper, for first-surface image formation in a double-sided image formation mode, whereas output color image data in such a manner that an image is gradually formed in an order from its front-end portion to its rear-end portion, for second-surface image formation in the double-sided image formation mode.

According to the invention, in the double-sided image formation mode, the order of supplying color image data to the second image forming section set for the first-surface image formation is the reverse of that set for the second-surface image formation. Accordingly, color image data for the first and second surfaces can be supplied to the second image forming section in a manner suited for the following recording-paper conveyance method adopted in the double-sided image formation mode: the conveying direction of the recoding paper having passed through the second image forming section once is reversed, and then, during the interval when the recoding paper is passing through the second image forming section once again, a color image is formed on the first surface of the recoding paper. Thereafter, reversals of the traveling directions of both surfaces of the recording paper are completed. In this state, the conveying direction of the recoding paper having passed through the second image forming section once is reversed. Then, during the interval when the recoding paper is passing through the second image forming section once again, a color image is formed on the second surface of the recoding paper.

The invention still further provides an image forming apparatus comprising:

a first image forming section for performing image formation based on monochromatic image data;

a second image forming section for performing image formation based on color image data, the first and second image forming sections being arranged in mutually different positions along a path for conveying recording paper; and an image processing section for outputting monochromatic image data or color image data, which have undergone enlargement or reduction process, to the first image forming section or the second image forming section.

According to the invention, monochromatic image data to be supplied to the first image forming section or color image data to be supplied to the second image forming section are subjected to enlargement or reduction process. Thus, even in a case where the recording paper undergoes deformation while passing through at least one of the first and second image forming sections, the monochromatic image and the color image formed on the recording paper conform to each other in size, so that the image data can be reproduced with accuracy.

In the invention, it is preferable that the image processing section subjects monochromatic image data or color image data to enlargement or reduction process in accordance with a deformed state of the recording paper, which has passed through a fixation unit for applying heat and pressure to the recording paper, in the first image forming section.

According to the invention, monochromatic image data or color image data is subjected to enlargement or reduction process in accordance with the deformed state of the recording paper having undergone heating and pressurizing in the first image forming section. This ensures that the monochromatic image and the color image formed on one surface or both surfaces of the recording paper conform to each other in size, so that the image data can be reproduced with high accuracy.

In the invention, it is preferable that storage means is provided for storing experimental data on a deformation amount of each of a plurality of recording paper sheets with varying sizes, which have passed through the fixation unit, and that, in the image processing section, in accordance with the size of the recording paper to be subjected to image formation and the number of passage of the fixation unit, an enlargement rate or reduction rate for monochromatic or color image data is determined with reference to the information stored in the storage means.

According to the invention, on the basis of the previously-stored experimental data on the deformation amount of the recording paper, monochromatic or color image data is subjected to enlargement or reduction process at the enlargement or reduction rate which is determined in accordance with the size of the recording paper and the number of heating and pressurizing operations. By exploiting the concrete experimental data, it is possible to ensure that the monochromatic image and the color image formed on one surface or both surfaces of the recording paper conform to each other in size, so that the image data can be reproduced with higher accuracy.

BRIEF DESCRIPTION OF THE DRAWINGS

Other and further objects, features, and advantages of the invention will be more explicit from the following detailed description taken with reference to the drawings wherein:

FIG. 4 is a flowchart showing the sequence of the processing procedure performed in the control unit of the digital copier;

FIG. 23 is a view showing a table which stores the relationship between the amount of deformation of the recording paper, and the size of the recording paper and the number of passage of the fixation unit.

DETAILED DESCRIPTION OF THE PREFERRED EMBODIMENTS

Figure 1:
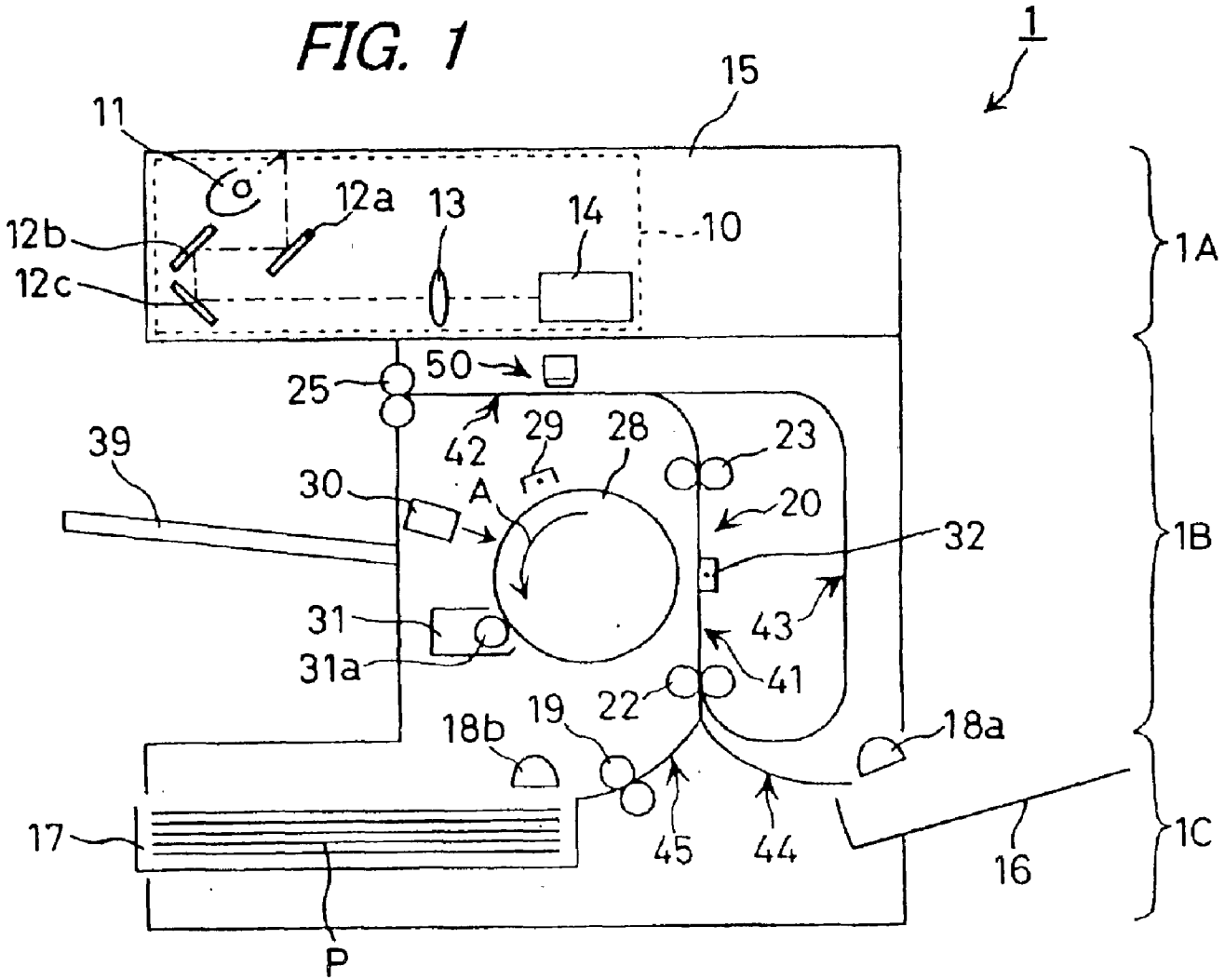
FIG. 1 is a schematic view showing the structure of the digital copier according to an embodiment of the invention.

Now referring to the drawings, preferred embodiments of the invention are described below.

Figure 2:
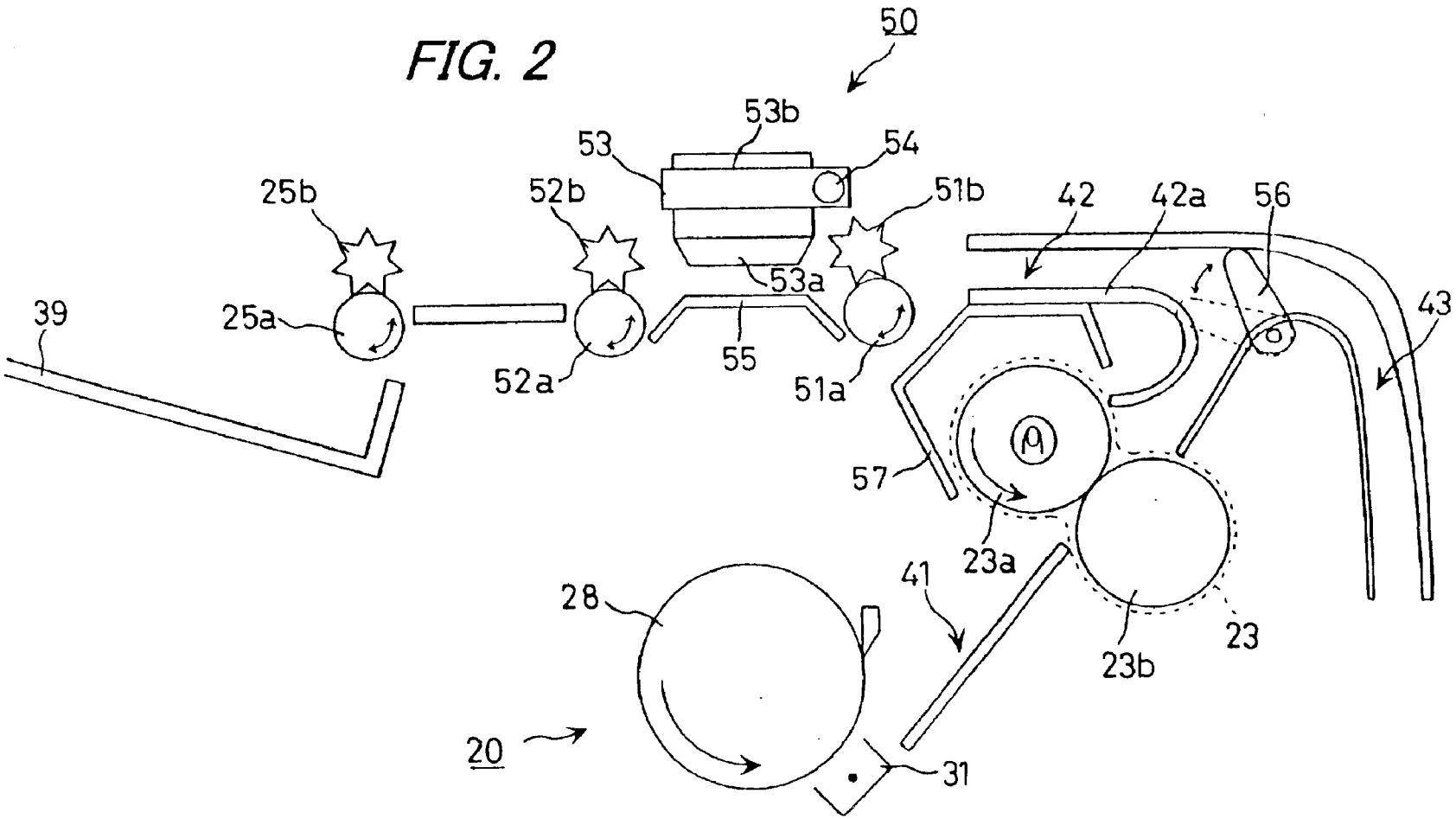
FIG. 2 is a view showing the structure of the periphery of the second image forming section provided in the printer unit of the digital copier.

Hereinafter, a description will be given as to an image forming apparatus according to an embodiment of the invention. Here, a digital copier is taken as an example. FIG. 1 is a schematic view showing the structure of the digital copier according to the embodiment of the invention. FIG. 2 is a view showing the structure of the periphery of the second image forming section provided in the printer unit of the digital copier. The digital copier 1 is designed to have in its upper part a scanner unit 1A, have in its middle part the printer unit 1B, and have in its lower part a paper supply unit 1C, so as to take a substantially U-shaped configuration.

The scanner unit 1A is provided with an original stand 15 made of transparent hard glass and a scanner optical system 10 located below the original stand 15. The original stand 15 is so arranged as to be exposed at the top surface of the digital copier 1. The scanner optical system 10 includes a light source lamp 11; mirrors 12*a* to 12*c*; a lens 13; and a CCD image sensor (hereafter simply referred to as the "CCD") 14. The exposure lamp 11, together with the mirror 12*a*, is moved reciprocally in a direction parallel to the under surface of the original stand 15, so that an image-carrying surface of an original placed on the top surface of the original stand 15 is exposed to light. The mirrors 12*b* and 12*c* are moved reciprocally in a direction parallel to the under surface of the original stand 15 at one half the speed of the light source lamp 11 and the mirror 12*a*, so that the light, which has been emitted from the light source lamp 11 and then reflected from the image-carrying surface of the original, is distributed to the lens 13, with its optical path length kept constant. The lens 13 serves to focus the light reflected from the image-carrying surface of the original onto a light-receiving surface of the CCD 14. The CCD 14 outputs a light-receiving signal in accordance with the quantity of light incident on the light-receiving surface. The light-receiving signal outputted from the CCD 14 is converted into digital data in a subsequently-described image forming section. The digital data is, after being subjected to predetermined image processing operation, supplied to the printer unit 1B as image data.

Although, in this example, explanation has been given to the case of employing a scanner unit adopting a stationary-original reading method, namely, a scanner unit in which image data of an original placed at a fixed position on the original stand is read out by a scanner optical system which is moved parallel to the original stand, a scanner unit adopting a moving-original reading method, or adopting the moving-original reading method and stationary-original reading method in combination can be employed instead.

The printer unit 1B is constituted by a combination of a first image forming section 20 (the first image forming section of the invention) and a second image forming section 50 (the second image forming section of the invention). The first image forming section 20 is designed for performing monochromatic image formation based on the electrophotographic system, and the second image forming section 50 is designed for performing color image formation based on the ink-jet system. With this construction, it is possible to make the most of the advantages of both of the electrophotographic system which excels in speed enhancement, and the ink-jet system which excels in color image reproducibility, so that satisfactory image formation can be achieved.

The first image forming section 20 is basically composed of a photoconductive drum 28; a charger 29; a laser scanning unit (hereafter abbreviated as the "LSU") 30; a development unit 31; a transfer unit 32; and a fixation unit 23. The charging unit 29, the LSU 30, the development unit 31, the transfer unit 32, etc. are arranged around the photoconductive drum 28 in this order, along a rotation direction of the photoconductive drum 28. The fixation unit 23 is arranged downstream of the opposed position of the photoconductive drum 28 and the transfer unit 32 along a main conveying path 41. In the first image forming section 20, image formation is performed as follows. Firstly, the charging unit 29 applies predetermined electric charge evenly over the surface of the photoconductive drum 28 rotating in a direction indicated by an arrow A at a predetermined processing speed. Then, the LSU 30 radiates laser light which has been modulated in accordance with image data. Whereupon, an electrostatic latent image is formed on the surface of the photoconductive drum 28. The development unit 31 supplies developer to the surface of the photoconductive drum 28, on which an electrostatic latent image is formed, by way of a development roller 31*a*, so that the electrostatic latent image is visualized as a developer image. The transfer unit 32 transfers the developer image carried on the surface of the photoconductive drum 28 to a surface of recording paper P. Note that the surface of the photoconductive drum 28 having undergone transfer process is subjected to removal of the residual developer and charge remaining thereon by means of non-illustrated cleaner and charge remover, so that the photoconductive drum 28 is reusable for image formation process. The fixation unit 23 functions as follows. As shown in FIG. 2, a heat-applying roller 23*a* and a pressure-applying roller 23*b* are brought into press contact with each other under a predetermined pressing force, so as to apply heat and pressure to the recording paper P which passes through the region therebetween. A toner image transferred onto the recording paper P is pressed under high temperature and pressure, and is thereby thermally fixed onto the recording paper P.

In the printer unit 1B, the second image forming section 50 is arranged in a conveying path designed for paper discharge (hereafter referred to as the "discharged-paper conveying path") 42 which is continuous with the downstream side of the main conveying path 4l in the paper conveying direction. In the second image forming section 50, as shown in FIG. 2, a carriage 53, which incorporates an ink head 53*a* and an ink tank 53*b*, is supported so as to be movable reciprocally in the main scanning direction via a shaft 54, and also a platen 55 is arranged so as to face the carriage 53 across the discharged-paper conveying path 42. Moreover, within the discharged-paper conveying path 42, conveying rollers 51*a* and 52*a*, acting as conveying members, are arranged immediately in front of the second image forming section of the invention. The conveying rollers 51*a* and 52*a*, placed on opposite sides of the opposed position of the carriage 53 and the platen 55, are supported so as to be freely rotated in both normal and reverse directions. Besides, star-shaped rollers 51*b* and 52*b* are supported at their axes on the upper parts of the conveying rollers 51*a* and 52*a*, respectively. The recording paper P is conveyed while being sandwiched between the conveying roller 51*a*, 52*a* and the star-shaped roller 51*b*, 52*b*. By using the star-shaped rollers 51*b* and 52*b*, as well as a subsequently-described star-shaped roller 25*b*, in the second image forming section 50, the area of the contact surface between the rollers and the image-carrying surface of the recording paper P on which an ink image is formed can be reduced, thereby preventing occurrence of blots in the image obtained.

The carriage 53 is moved in the main scanning direction, with the recording paper P kept at rest between the carriage 53 and the platen 55. During this time, ink is selectively ejected from a plurality of nozzles of the ink head 53*a*, which is driven on the basis of the image data. Upon completion of one-line movement of the carriage 53 in the main scanning direction, by the rotation of the conveying rollers 51*a* and 52*a*, the recording paper P is conveyed by a distance equivalent to the arrangement interval of the nozzle in ink head 53*a*. By repeating the movement of the carriage 53 in the main scanning direction, during which the ink head 53*a* is being driven, and the intermittent conveyance of the recording paper P, an ink image is formed over the entire surface of the recording paper P.

Note that, within the printer unit 1B is formed, in addition to the main conveying path 41 and the discharged-paper conveying path 42, a sub conveying path 43. Between the main conveying path 41 and the discharged-paper conveying path 42 is swingably disposed a flapper 56 for opening and closing the sub conveying path 43.

The paper supply unit 1C is provided with a feeding tray 16 attached to one side face of its main body; a feeding cassette 17 detachably attached to the main body, for accommodating a plurality of paper sheets; pickup rollers 18*a* and 18*b* for paying out the recording paper P placed on the feeding tray 16 or housed within the feeding cassette 17, on a one-by-one basis; and a feeding roller 19 for feeding the recording paper P paid out from the pickup roller 18*b* to the printer unit 1B. In the paper supply unit 1C are formed paper conveying paths 44 and 45 for bringing each of the feeding tray 16 and the feeding cassette 17 into communication with the main conveying path 41 on the upstream side.

Within the printer unit 1B, along the main conveying path 41 is arranged, in addition to the heat-applying roller 23*a* and the pressure-applying roller 23*b* constituting the fixation unit 23, a resist roller 22 which is a conveying member arranged immediately in front of the first image forming section of the invention. The resist roller 22, prior to the rotation of the photoconductive drum 28, brings the recording paper P fed from the paper supply unit 1C to a stop once, and thereafter guides it to the region between the photoconductive drum 28 and the transfer unit 32 in synchronism with the rotation of the photoconductive drum 28. That is, the resist roller 22 is kept unrotated at the time when the recording paper P is fed from the paper supply unit 1C, yet starts to rotate at a timing with which, in the opposed position of the photoconductive drum 28 and the transfer unit 32, the front-end part of the recording paper P coincides with the front-end part of the toner image carried on the photoconductive drum 28.

In the digital copier 1, a discharge tray 39 is attached to one side face of the printer unit 1B so as to be located in a gap between the scanner unit 1A and the paper supply unit 1C. The discharged-paper conveying path 42, formed within the printer unit 1B, serves to bring the downstream-side end of the main conveying path 41, in the paper conveying direction, into communication with the discharge tray 39. The discharged-paper conveying path 42 has, at its discharge tray 39-side end, a discharge roller 25*a* paired up with the star-shaped roller 25*b*. The discharge roller 25*a* is, like the conveying rollers 51*a* and 52*a*, designed to be rotatable in both normal and reverse directions. The discharge roller 25*a*, as well as the conveying rollers 51*a* and 52*a*, is used to realize a double-sided image formation function in the first image forming section 20.

That is, in the case of a single-sided image formation mode for forming an image on one surface of the recording paper P in the first image forming section 20, the flapper 56 is set in a position indicated by a solid line in FIG. 2, and the conveying rollers 51*a*, 52*a* and the discharge roller 25*a* are normally rotated in a clockwise direction, as viewed in FIG. 2. In this state, the recording paper P having passed through the fixation unit 23 passes through the discharged-paper conveying path 42 so as to be discharged onto the discharge tray 39. By contrast, in the case of a double-sided image formation mode for forming an image on both surfaces of the recording paper P, during formation of an image on a first surface of the recording paper (the first-surface image formation), at the time when the rear-end part of the recording paper P passes through the conveying roller 52*a* the flapper 56 is shifted to a position indicated by a broken line in FIG. 2, and the conveying rollers 51*a*, 52*a* and the discharge roller 25*a* are reversely rotated in a counterclockwise direction, as viewed in FIG. 2. In this state, the recording paper P is guided into the sub conveying path 43 and then, at the time when the entire surface of the recording paper P is wholly shifted into the sub conveying path 43, the flapper 56 is shifted to the position indicated by the solid line in FIG. 2. The recording paper P having passed through the sub conveying path 43 is guided through the upstream side of the main conveying path 41 to the first image forming section 20, with its surface turned upside down. Then, after being subjected to formation of an image on a second surface of the recording paper (the second-surface image formation), the recording paper P is discharged onto the discharge tray 39 by the conveying rollers 51*a*, 52*a* and the discharge roller 25*a* rotating normally in a clockwise direction, as viewed in FIG. 2.

Note that, in the following explanation, a combination of the conveying roller 51*a* and the star-shaped roller 51*b* is defined as a conveying roller 51; a combination of the conveying roller 52*a* and the star-shaped roller 52*b* is defined as a conveying roller 52; and a combination of the discharge roller 25*a* and the star-shaped roller 25*b* is defined as a discharge roller 25.

Figure 3:
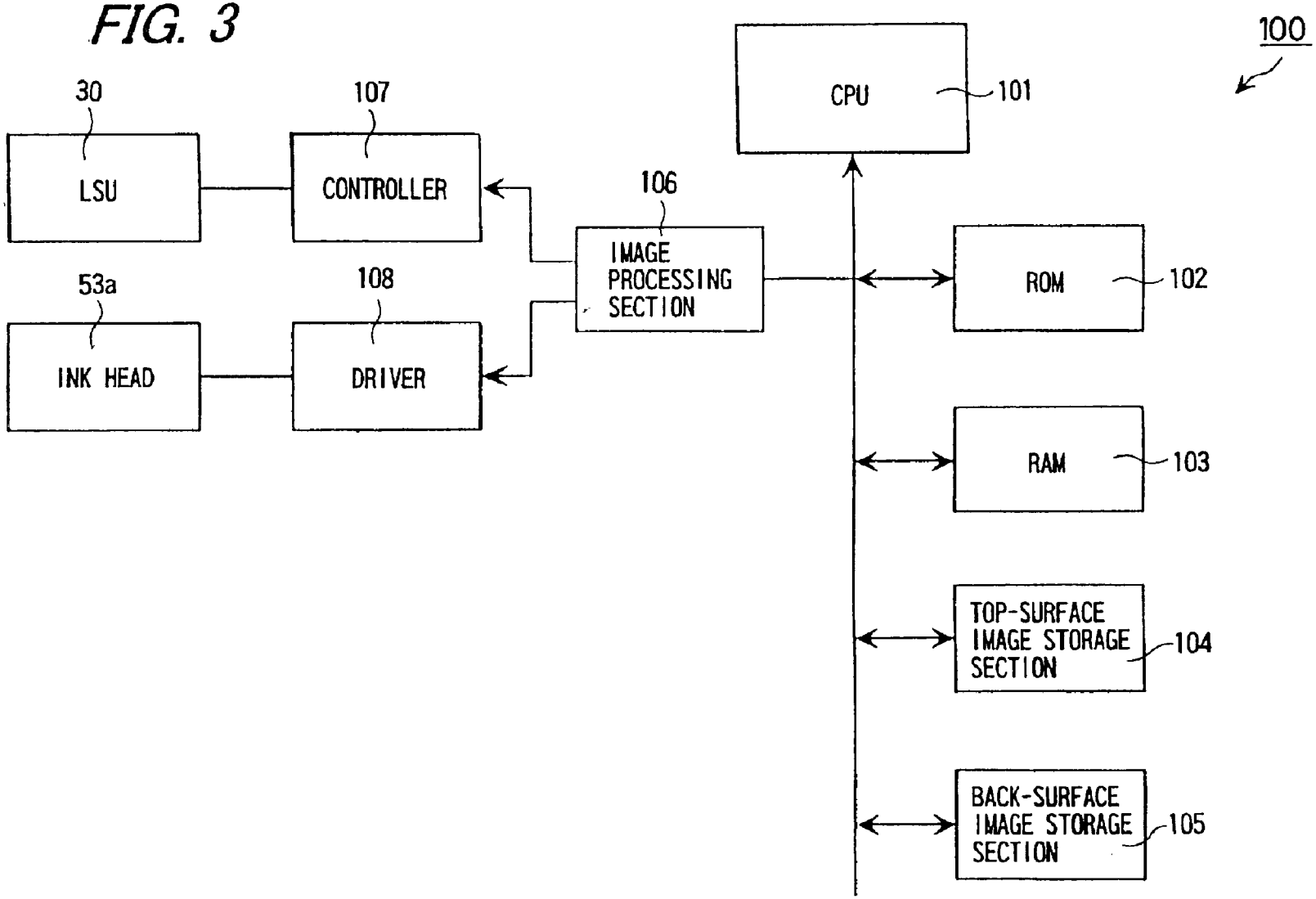
FIG. 3 is a view showing the structure of the control unit incorporated in the digital copier.

FIG. 3 is a view showing the structure of the control unit incorporated in the digital copier. The control unit 100 of the digital copier is constituted by connecting a top-surface image storage section 104, a back-surface image storage section 105, and an image processing section 106 to a CPU 101 incorporating a ROM 102 and a RAM 103. The top-surface image storage section 104 and the back-surface image storage section 105 store top-surface image data and back-surface image, respectively, that are respectively read out from a top surface and a back surface of a single original by the scanner unit 1A.

The image processing section 106 performs predetermined image processing operation on the image data stored in the top-surface image storage section 104 and the back-surface image storage section 105. Connected to the image processing section 106 are a controller 107 of the LSU 30, disposed in the first image forming section 20, and a driver 108 of the ink head 53*a*, disposed in the second image forming section 50. The image processing section 106 supplies monochromatic image data having undergone the predetermined image processing to the controller 107 at a predetermined timing, and also supplies color image data having undergone the predetermined image processing to the driver 108 at a predetermined timing.

FIG. 4 is a flow chart showing the sequence of the processing procedure performed in the control unit of the digital copier. When power is turned on, in step s1, the CPU 101 of the control unit 100 is set ready for an input about image formation request after initialization. When the image formation request is inputted, in step s2, the CPU 101 judges whether an original targeted for image formation is a single-sided original, and if not, in step s3, judges whether the original is a double-sided original. If the original is judged as a single-sided original, in step s4, the CPU 101 reads out the image of the original by means of the scanner unit 1A. Then, in step s5, after the read image data is stored in the top-surface image storage section 104, in step s6, a predetermined image processing operation is performed on the image data stored in the top-surface image storage section 104, in the image processing section 106. On the other hand, if an original targeted for image formation is judged as a double-sided original, in step s7, the CPU 101 reads out image data from the top surface of the original by means of the scanner unit 1A, and then, in step s8, stores the image data in the top-surface image storage section 104, and also stores the image data read out from the back surface of the original in the back-surface image storage section 105. Then, in step s9, the predetermined image processing operation is performed on the image data stored in the top-and back-surface image storage sections 104 and 105, in the image processing section 106.

Subsequently, in steps s10 through s12, the CPU 101 judges whether the image data stored in the top- and back-surface image storage sections 104 and 105 consists solely of monochromatic image data, consists solely of color image data, or consists of mixed image data composed of a combination of monochromatic and color image data. If it is judged that only monochromatic image data is stored, in step s13, the CPU 101 performs electrophotographic system-based monochromatic image formation in the first image forming section 20. If it is judged that only color image data is stored, in step s14, the CPU 101 performs ink-jet system-based color image formation in the second image forming section 50. If it is judged that mixed image data is stored, in step s15, the CPU 101 performs mixed image formation in the first and second image forming sections 20 and 50. In step 16, if it is judged that a next original is present, the process returns to step s2. The CPU 101 performs the process steps ranging from s2 to s15 repeatedly on every original, under image formation request.

Note that, in the image processing section 106, mixed image data, which has been read out from an original carrying an image obtained by combining monochromatic and color images, is stored in the image storage sections 104 and 105 and supplied to the controller 107 and the driver 108 in a manner different from that which has conventionally been in use. That is, in a conventional image forming apparatus, two individual image processing sections are provided separately for monochromatic image data and for color image data. Moreover, in the case of dealing with mixed image data, for each of top and back surfaces of an original, the corresponding image data is classified into monochromatic image data and color image data, and the classified image data is, after being subjected to predetermined image processing, stored in the top- and back-surface image storage sections.

Figure 5:
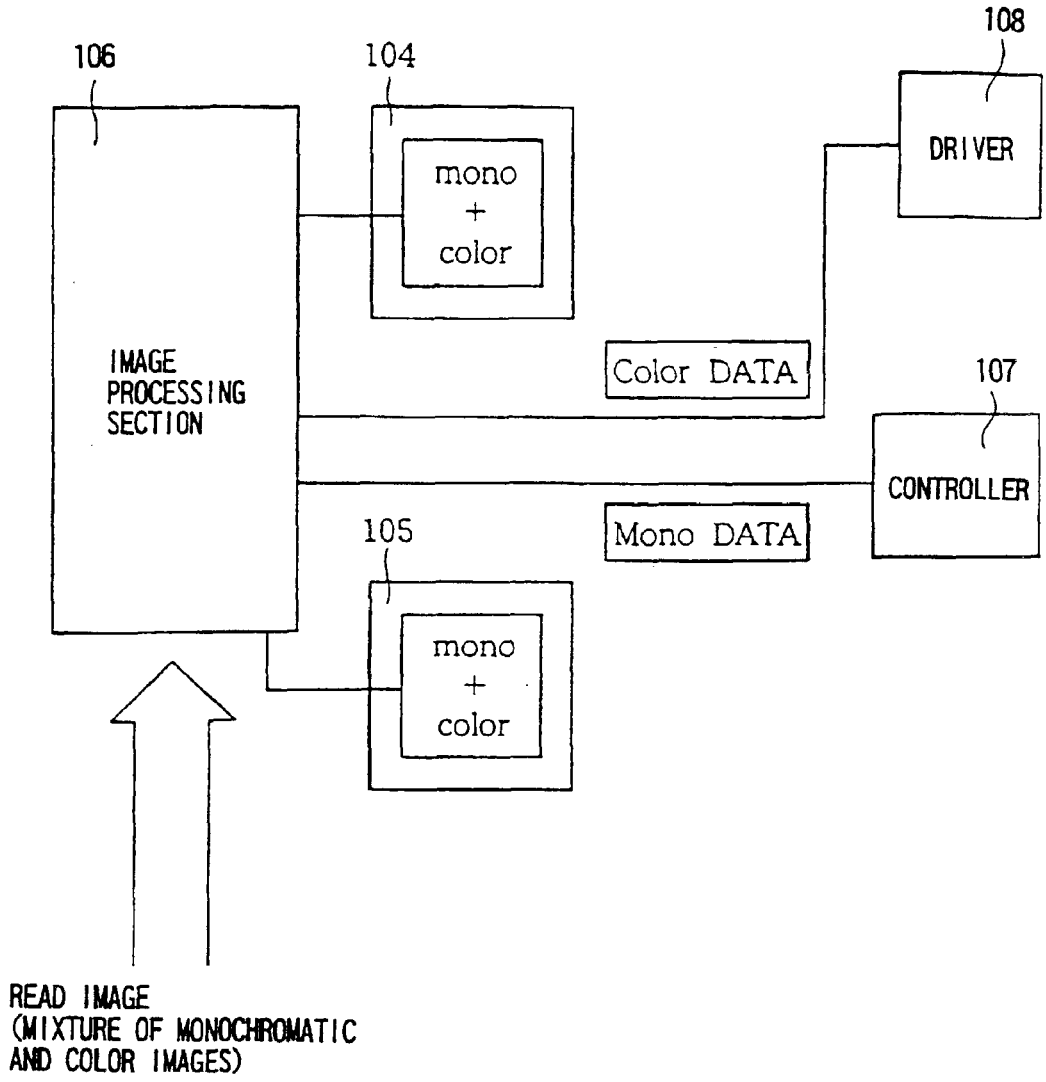
FIG. 5 is a view of assistance in explaining how image processing is performed in the image processing section constituting part of the control unit.

By contrast, the image processing section 106 embodying the invention has the following distinctive feature. As shown in FIG. 5, mixed image data read out from top and back surfaces of an original is, after being subjected to predetermined image processing in the unitary image forming section 106, stored in the top- and back-surface image storage sections 104 and 105, without being classified into monochromatic image data and color image data. Then, during image formation in the first and second image forming sections 20 and 50, a determination is made as to whether the image data read out from the top- and back-surface image storage sections 104 and 105 is monochromatic image data or color image data. Thereafter, monochromatic image data is supplied to the controller 107 of the LSU 30, whereas color image data is supplied to the driver 108 of the ink head 53*a*.

It should be noted, however, that monochromatic image formation in the first image forming section 20 and color image formation in the second image forming section 50 are not performed concurrently. Thus, in the image processing section 106, when electrophotographic-system monochromatic image formation is executed in the first image forming section 20, only the data judged as monochromatic image data is supplied to the first image forming section 20, and, when color image formation is executed in the second image forming section 50, only the data judged as color image data is supplied to the second image forming section 50.

In this way, the image processing section 106 is capable of storing mixed image data without classifying the data into monochromatic image data and color image data. This helps reduce the storage capacity of the top- and back-surface image storage sections 104 and 105. Another advantage is that monochromatic image data and color image data can be handled in the same processing path. This helps simplify the structure of the image processing section 106.

In this case, the judgment on whether the data supplied from the image processing section 106 to the controller 107 and the driver 108 is monochromatic image data or color image data should desirably be made readily with accuracy. In light of this, for example, the image processing section 106 is designed to make the judgment on whether the supplied data is monochromatic image data or color image data on the basis of individual hue values for additive primary colors R (red), G (green), and B (blue), in accordance with the procedure shown in the flow chart of FIG. 6.

Figure 6:
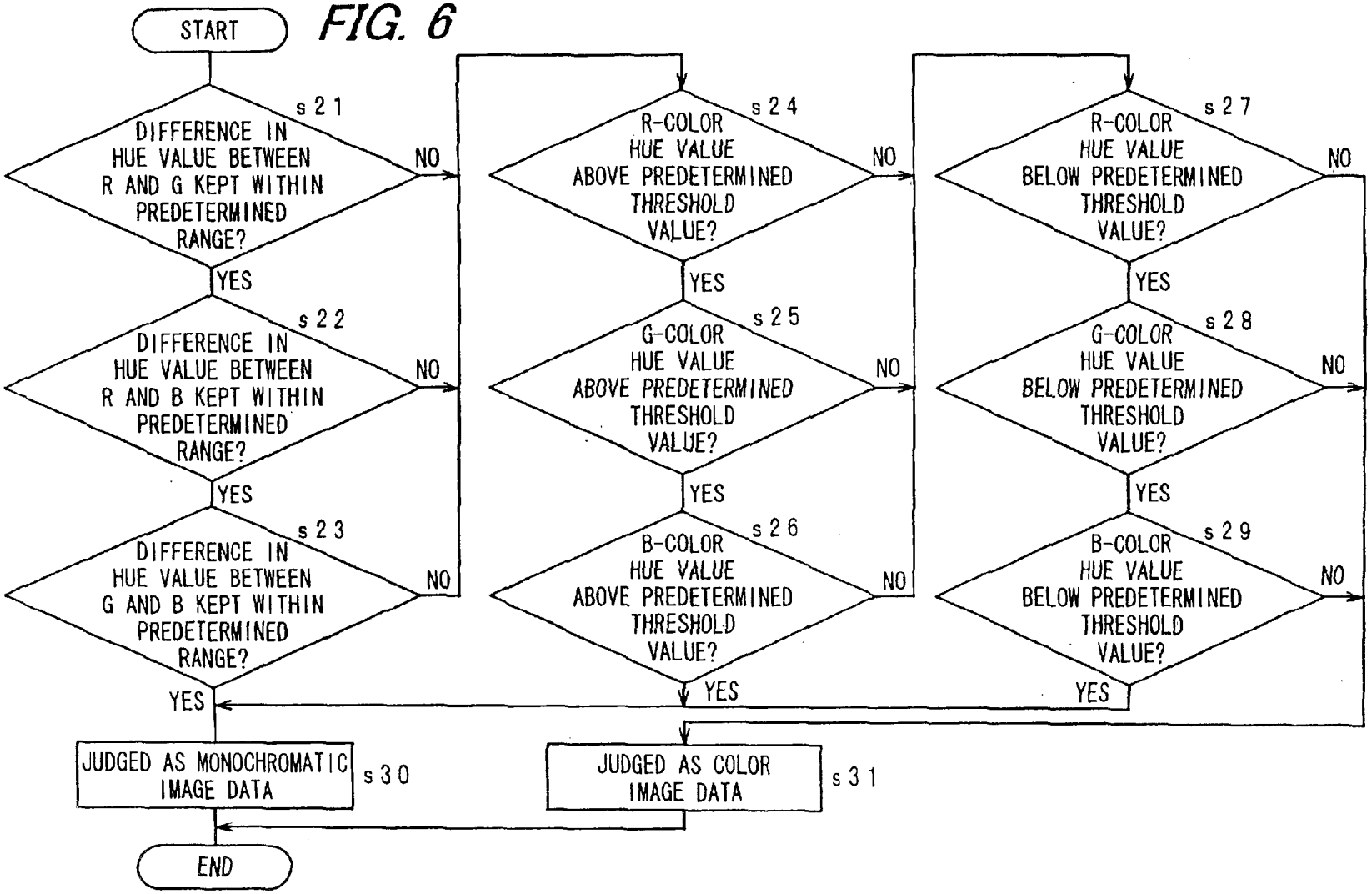
FIG. 6 is a flow chart showing the sequence of the processing procedure performed in the image processing section, for judging whether the data supplied is monochromatic image data or color image data.

In FIG. 6, in steps s21 through s23, the image processing section 106 judges whether or not the difference in hue value between colors R, G, and B is kept within a predetermined range. If the difference in hue value between the colors R, G, and B is kept within a predetermined range, in step s30, the image processing section 106 judges that the data is monochromatic image data. This judgment is made based on the fact that the colors R, G, and B are substantially identical in hue value with each other in a gray-scale image.

If the difference in hue value between any two colors of R, G, and B is beyond the predetermined range, in the image processing section 106, in steps s24 through s26, the hue values of the colors are each compared with a predetermined threshold value. If all of the hue values are greater than the predetermined threshold value, in step s30, the image processing section 106 judges that the data is monochromatic image data. This judgment is made based on the fact that the colors R, G, and B all exhibit a high hue value in a gray-scale image.

If the difference in hue value between any two colors of R, G, and B is kept within the predetermined range, in the image processing section 106, in steps s27 through s29, the hue values of the colors are each compared with a predetermined threshold value. If all of the hue values are equal to or less than the predetermined threshold value, in step s30, the image processing section 106 judges that the data is monochromatic image data. This judgment is made based on the fact that the colors R, G, and B all exhibit a low hue value in a gray-scale image. Throughout the procedure ranging from steps s21 to s29, image data that has not been judged as monochromatic image data is judged as color image data in step s31.

According to the foregoing procedure, the judgment on whether the supplied data is monochromatic image data or color image data can be made readily with accuracy.

Next, descriptions will be given below as to recording paper conveyance status and image data processing status as observed during image formation performed in the digital copier 1, separately for the case of forming a monochromatic image, the case of forming a color image, and the case of forming a mixed image. In the following description, "the front end of the recording paper P" means the main-conveying-path 41-side end of the recording paper P, as observed in a state where the recording paper P is placed on the feeding tray 16, or a state where it is housed in the feeding cassette 17. On the other hand, "the rear end of the recording paper P" means the end of the recording paper P opposite to the front end thereof.

(1) Monochromatic Image Formation

Figure 7:
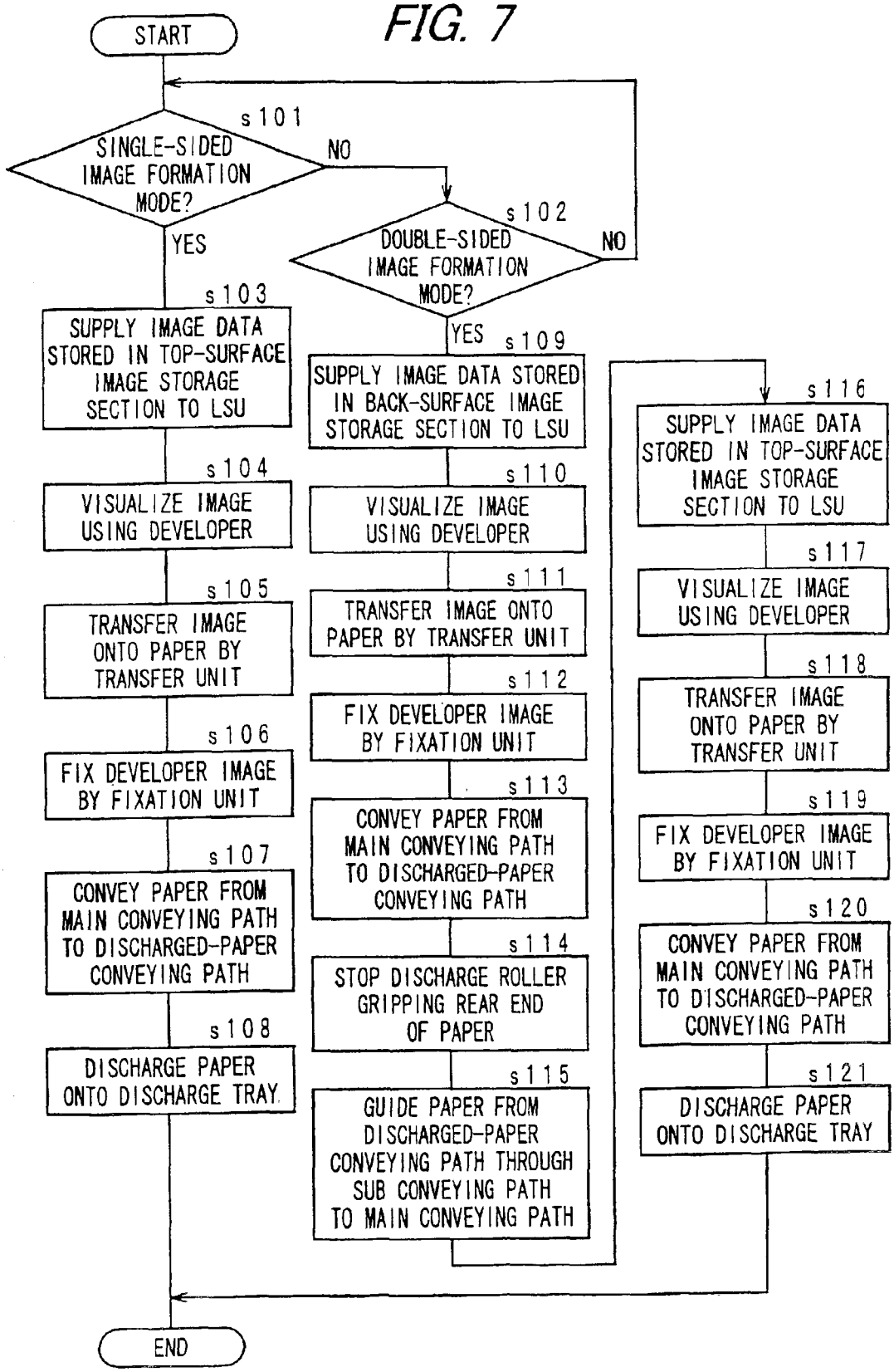
FIG. 7 is a flow chart showing the sequence of the processing procedure performed in the digital copier embodying the invention, for performing monochromatic image formation.
Figure 8A:
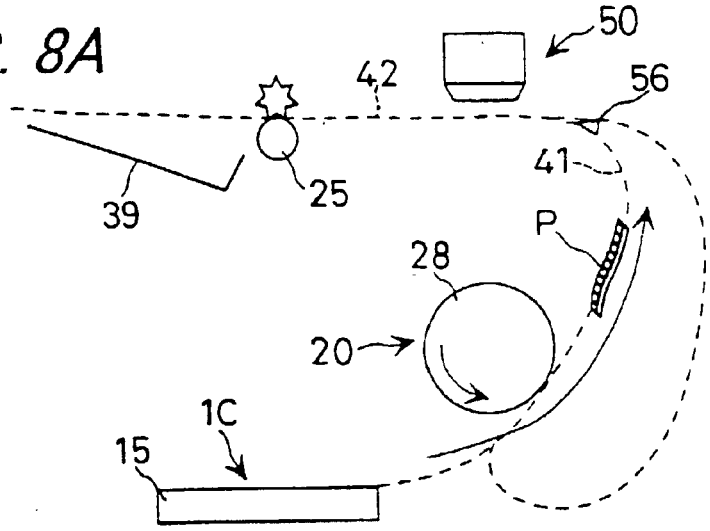
FIGS. 8A to 8C are views of assistance in explaining the path through which recording paper is conveyed, for a case where monochromatic image formation in a single-sided image formation mode is performed in the digital copier.

Monochromatic image formation in the first image forming section 20 based on the electrophotographic system will be performed as follows. As shown in the flow chart of FIG. 7, firstly, in steps s101 and s102, the CPU 101 judges whether image formation is performed based on a single-sided image formation mode for forming an image on one surface of the recording paper P, or on a double-sided image formation mode for forming an image on both surfaces of the recording paper P. In the case of the single-sided image formation mode, in step s103, the CPU 101 reads out monochromatic image data for the top surface, which is stored in the top-surface image storage section 104, in the order from part of the data corresponding to part of an image to be formed on the front-end part of the recording paper P. The monochromatic image data thus obtained is then supplied, via the image processing section 106, to the controller 107 at a timing synchronized with the driving timing set for the resist roller 22. That is, the image processing section 106 outputs monochromatic image data to the controller 107 in such a manner that an image is gradually formed in an order from its front-end portion to its rear-end portion on the recording paper P. Thereby, in the first image forming section 20, an electrostatic latent image is formed on the surface of the photoconductive drum 28 by the LSU 30. Next, in step s104, under the control of the CPU 101, the resultant electrostatic latent image is visualized as a developer image using the developer supplied from the development unit 31. Then, in step s105, during the interval when the recording paper P fed from the paper supply unit 1C is passing through the region between the photoconductive drum 28 and the transfer unit 32, as shown in FIG. 8A, the developer image is transferred onto the recording paper P by the transfer unit 32.

Figure 8B:
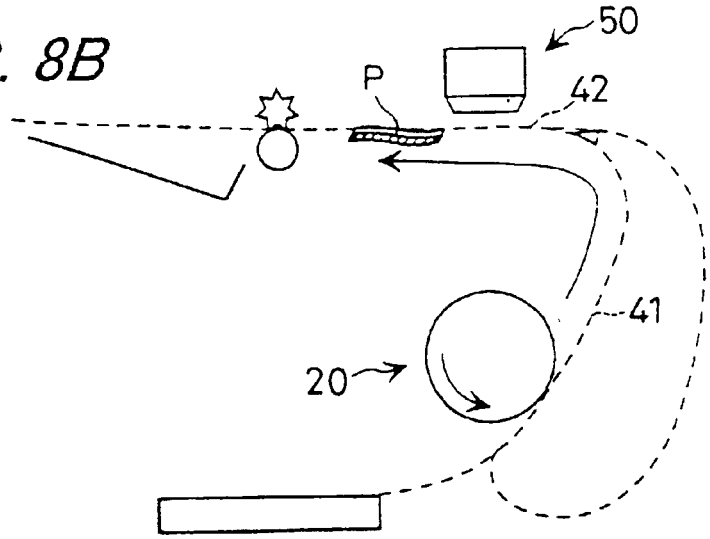
Figure 8C:
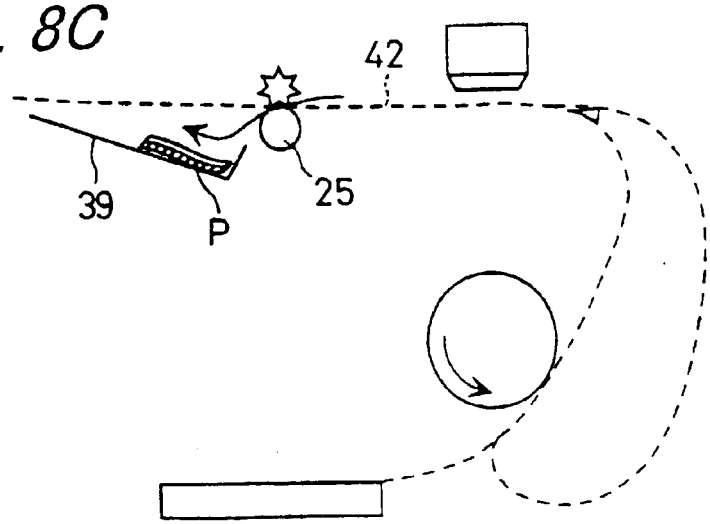

Subsequently, in step s106, under the control of the CPU 101, the fixation unit 23 applies heat and pressure to the recording paper P, whereupon the developer image is fixed onto the recording paper P. Then, in step s107, the flapper 56 is set in a position indicated by the solid line in FIG. 2 to provide communication between the main conveying path 41 and the discharged-paper conveying path 42, permitting the recording paper P to pass through the second image forming section 50, as shown in FIG. 8B. Finally, in step s108, as shown in FIG. 8C, the recording paper P is discharged onto the discharge tray 39 in such a manner that its monochromatic-image carrying surface faces downward, i.e., in a Face-Down manner.

Figure 9A:
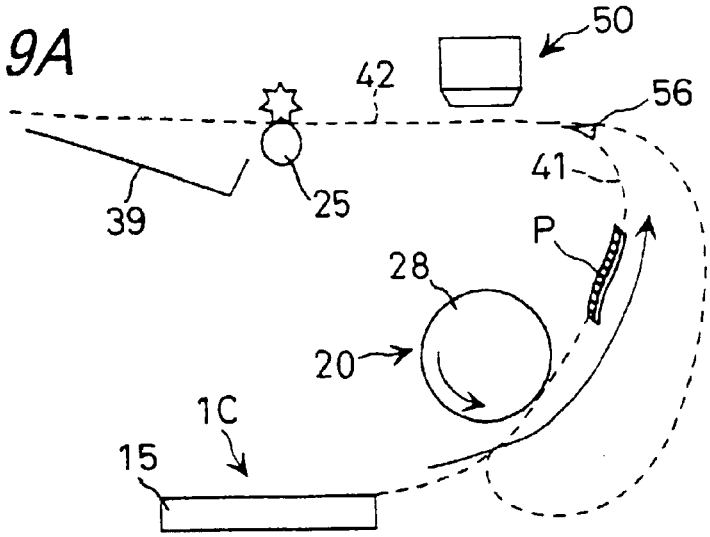
FIGS. 9A to 9C are views of assistance in explaining the path through which recording paper is conveyed, for a case where monochromatic image formation in a double-sided image formation mode is performed in the digital copier.
Figure 9B:
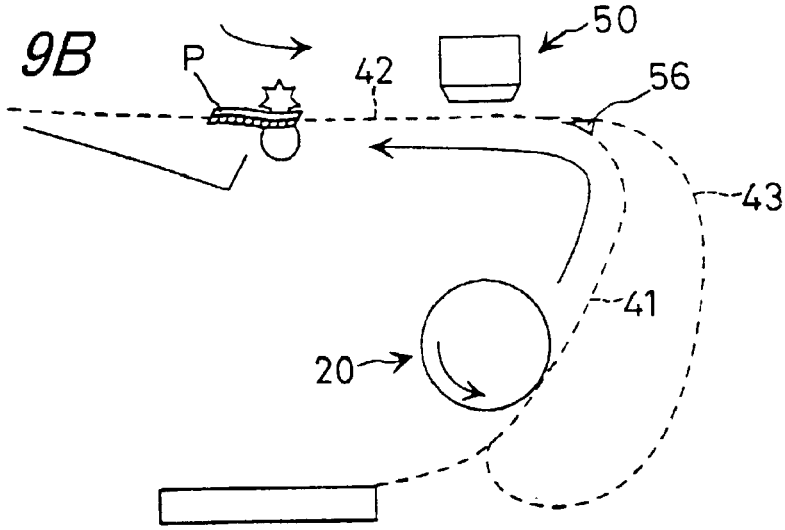

In the case of the double-sided image formation mode, in step s109, the CPU 101 reads out monochromatic image data for the back surface stored in the back-surface image storage section 105 in the order from part of the data corresponding to part of an image to be formed on the front-end part of the recording paper P. The monochromatic image data thus obtained is supplied, via the image processing section 106, to the first image forming section 20 at a timing synchronized with the driving timing set for the resist roller 22. That is, the image processing section 106 outputs back-surface monochromatic image data to the controller 107 in such a manner that an image is gradually formed in an order from its front-end portion to its rear-end portion on the recording paper P. Next, in steps s110 through s113, under the control of the CPU 101, in accordance with the same process steps as in steps s104 through s107, as shown in FIG. 9A, the recording paper P, now carrying a developer image on its first surface as a result of the operation performed by the first image forming section 20, is guided to the discharged-paper conveying path 42. Subsequently, in step s114, after the discharge roller 25 is brought to a stop, with the rear-end part of the recording paper P having passed through the second image forming section 50 kept gripped by the discharge roller 25, in step s115, the flapper 56 is set in a position indicated by the broken line in FIG. 2 to provide communication between the discharged-paper conveying path 42 and the sub conveying path 43, so that the conveying rollers 51, 52 and the discharge roller 25 are reversely rotated, as shown in FIG. 9B. Thereby, the recording paper P is guided through the sub conveying path 43 to the main conveying path once again, with its surface turned upside down.

Figure 9C:
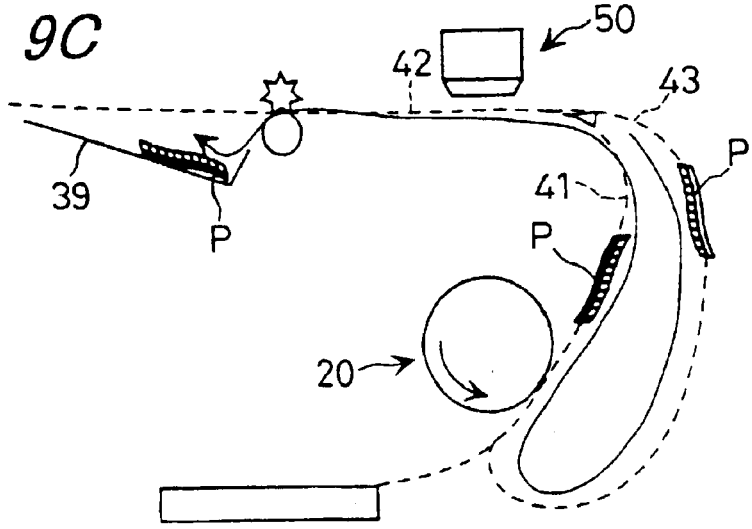

Thereafter, in step s116, the CPU 101 reads out the monochromatic image data for the top surface stored in the top-surface image storage section 104 in the order from part of the data corresponding to part of an image to be formed on the rear-end part of the recording paper P. The monochromatic image data thus obtained is supplied, via the image processing section 106, to the first image forming section 20 at a timing synchronized with the driving timing set for the resist roller 22. That is, the image processing section 106 outputs top-surface monochromatic image data to the controller 107 in such a manner that an image is gradually formed in an order from its rear-end portion to its front-end portion on the recording paper P. Then, in steps s117 through s121, under the control of the CPU 101, in accordance with the same process steps as in steps s104 through s108, as shown in FIG. 9C, the recording paper P, now carrying a developer image on its first surface as a result of the operation performed by the first image forming section 20, passes through the discharged-paper conveying path 42 so as to be discharged onto the discharge tray 39 in the Face-Down manner.

As described hereinabove, in the case of forming a monochromatic image in the double-sided image formation mode, the back surface of the recording paper P is subjected to image formation earlier than the top surface thereof, for the following reason. Even in a case where images spreading across page boundaries are formed on both surfaces of a plurality of recording paper sheets P, there is no need to collate the pages of the recording paper sheets P discharged onto the discharge tray 39 (collating operation). Besides, the back-surface monochromatic image data is read out in the order from its part corresponding to part of an image to be formed on the front-end part of the recording paper P, whereas the top-surface monochromatic image data is read out in the order from its part corresponding to part of an image to be formed on the rear-end part of the recording paper P. This is because, in order for the recoding paper P to be turned upside down while passing through the main conveying path 41 twice, upon completion of image formation on the back surface, the recoding paper P is switched back in conveyance. As a result, the traveling direction of the recording paper P for the back-surface image formation is the reverse of that for the front-surface image formation.

(2) Color Image Formation

Color image formation in the second image forming section 50 based on the ink-jet system is performed as follows. As shown in the flow chart of FIG. 10, firstly, in steps s201 and s202, the CPU 101 judges whether image formation is performed based on the single-sided image formation mode for forming an image on one surface of the paper P, or on the double-sided image formation mode for forming an image on both surfaces of the paper P. In the case of the single-sided image formation mode, in step s203, under the control of the CPU 101, top-surface color image data stored in the top-surface image storage section 104 is read out in the order from its part corresponding to part of an image to be formed on the rear-end part of the recording paper P. Meanwhile, in step s204, under the control of the CPU 101, the recording paper P fed from the paper supply unit 1C is conveyed through the main conveying path 41, and, in step s205, the flapper 56 is set in a position indicated by the solid line in FIG. 2 to guide the recording paper P to the discharged-paper conveying path 42. Then, in step s206, as shown in FIG. 11A, the discharge roller 25 is brought to a stop, with the rear-end part of the recording paper P kept gripped by the discharge roller 25.

Figure 11A:
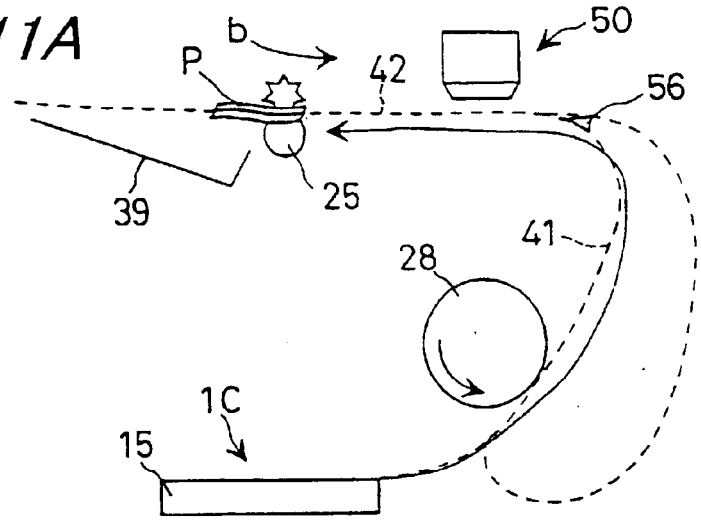
FIGS. 11A to 11C are views of assistance in explaining the path through which recording paper is conveyed, for a case where color image formation in a single-sided image formation mode is performed in the digital copier shown in FIG. 10.
Figure 11B:
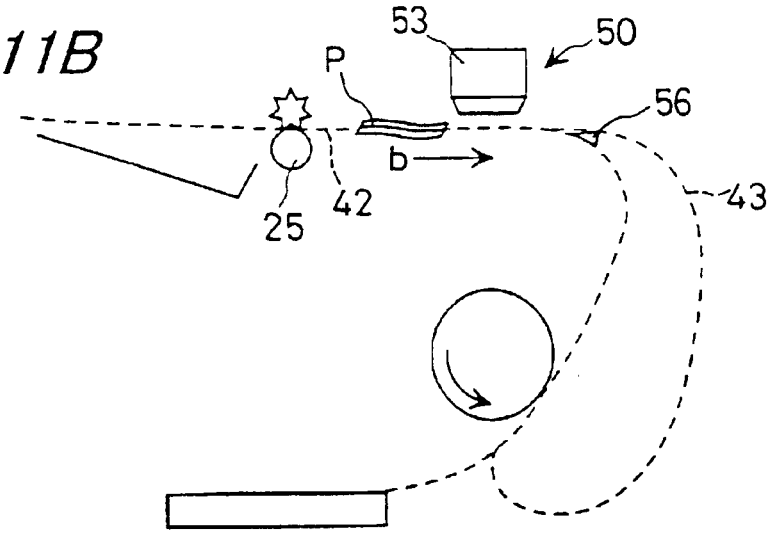

Subsequently, in step s207, under the control of the CPU 101, the flapper 56 is set in a position indicated by the broken line in FIG. 2 to provide communication between the discharged-paper conveying path 42 and the sub conveying path 43. In this state, as shown in FIG. 11B, the discharge roller 25 is rotated reversely until the rear end of the recording paper P reaches the conveying roller 52, so that the recording paper P is conveyed in a direction indicated by an arrow b shown in FIG. 11. Then, in step s208, top-surface color image data is supplied, via the image processing section 106, to the driver 108 of the ink head 53*a* at a timing synchronized with the driving timing set for the conveying roller 52 (at the timing with which the rear end of the recording paper P coincides with the color image data corresponding to the rear-end part of the image). After making adjustments to the conveyance of the recording paper P in the arrow-b direction and to the operations of the carriage 53 and the ink head 53*a* in the second image forming section 50, color image formation is performed on the recording paper P. That is, the image processing section 106 outputs top-surface color image data to the driver 108 in such a manner that an image is gradually formed in an order from its rear-end portion to its front-end portion on the recording paper P.

At this time, in the second image forming section 50, where image formation is performed in the following manner: during the interval when the carriage 53 incorporating the ink head 53*a* is being moved reciprocally in the main scanning direction perpendicular to the conveying direction of the recording paper P, ink is ejected from the nozzles of the ink head 53*a*, the recording paper P is intermittently conveyed by a distance equivalent to the arrangement interval of the nozzle in the sub scanning direction parallel to the conveying direction. Thus, in step s209, every time the one-line movement of the carriage 53 is completed, the CPU 101 judges whether or not image forming operation based on the whole of the color image data has been completed.

Moreover, since the flapper 56 provides communication between the discharged-paper conveying path 42 and the sub conveying path 43, the recording paper P is guided at its rear end into the sub conveying path 43 while being subjected to the ink-jet-system color image formation in the second image forming section 50. Thus, it never occurs that the recording paper P finds its way into the fixation unit 23 arranged within the main conveying path 41.

Figure 11C:
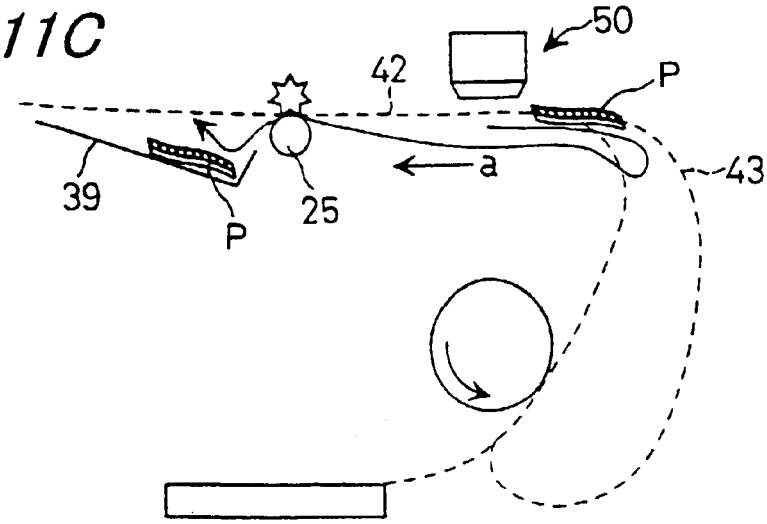

Upon completion of color image formation based on the whole of the color image data, in step s210, under the control of the CPU 101, as shown in FIG. 11C, the discharge roller 25 and the conveying rollers 51, 52 are normally rotated, so that the recording paper P is conveyed in a direction indicated by an arrow a within the discharged-paper conveying path 42. Finally, the recording paper P is discharged onto the discharge tray 39 in such a manner that its image carrying surface faces upward, i.e., in a Face-Up manner.

Note that, in this example, the recording paper P is discharged onto the discharge tray 39 in a Face-Up manner in order to shorten the time required for image formation. Alternatively, in order for the recording paper P to be discharged onto the discharge tray 39 in a Face-Down manner to eliminate the need for collating operation required to form continuous images on a plurality of paper sheets, the recording paper P having undergone color image formation performed by the second image forming section 50 is directly guided to the sub conveying path 43, and then passes through the main conveying path 41 and the discharged-paper conveying path 42, in this order, to be discharged.

Moreover, in this example, to facilitate drying of the ink deposited onto the recording paper P, image formation is performed in the second image forming section 50 during the interval when the recording paper P is being conveyed in the arrow-b direction, and the recording paper P having passed through the second image forming section 50 is brought to closer to the fixation unit 23 kept in a high-temperature state. Here, to further shorten the time required for image formation, color image formation is performed in the second image forming section 50 during the conveyance of the paper in the arrow-a direction shown in FIG. 11A, and the paper is directly discharged onto the discharge tray 39.

Figure 12A:
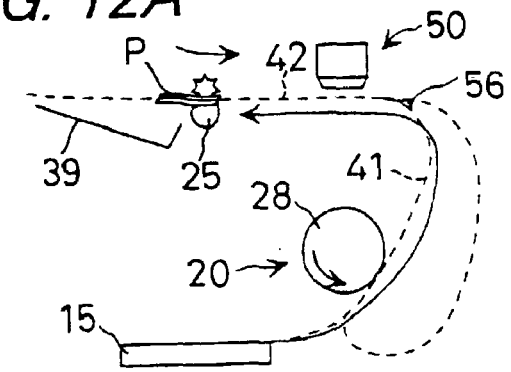
FIGS. 12A to 12E are views of assistance in explaining the path through which recording paper is conveyed, for a case where color image formation in a double-sided image formation mode is performed in the digital copier shown in FIG. 10.
Figure 12D:
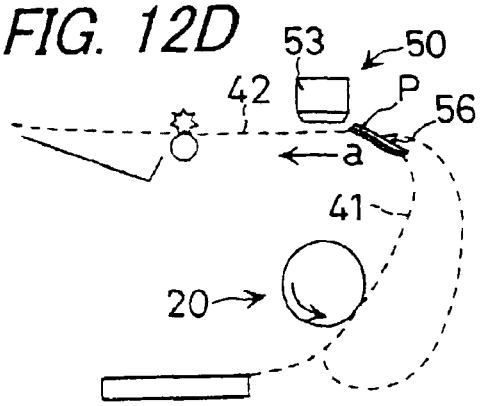
Figure 12B:
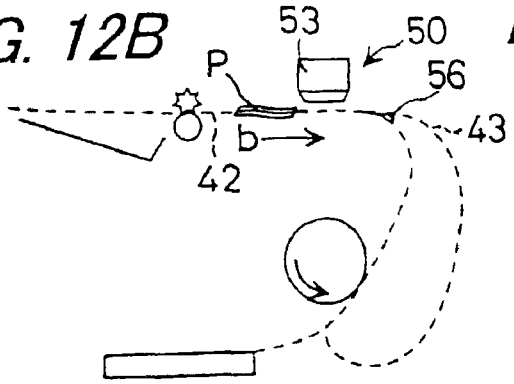

In the case of the double-sided image formation mode, in steps s211 through s218, under the control of the CPU 101, in accordance with the same process steps as in steps s203 through s209, as shown in FIGS. 12A and 12B, during the interval when the recording paper P is being conveyed along the discharged-paper conveying path 42 in the arrow-b direction, top-surface color image formation is performed on the first surface of the recording paper P in the second image forming section 50. That is, the image processing section 106 outputs top-surface color image data to the driver 108 in such a manner that an image is gradually formed in an order from its rear-end portion to its front-end portion on the recording paper P. At this time, under the control of the CPU 101, the flapper 56 is set in a position indicated by the broken line in FIG. 2 to provide communication between the discharged-paper conveying path 42 and the sub conveying path 43. Thereafter, under the control of the CPU 101, the conveying rollers 51, 52 and the discharge roller 25 are rotated reversely, so that the recording paper P is guided to the sub conveying path 43.

Figure 12E:
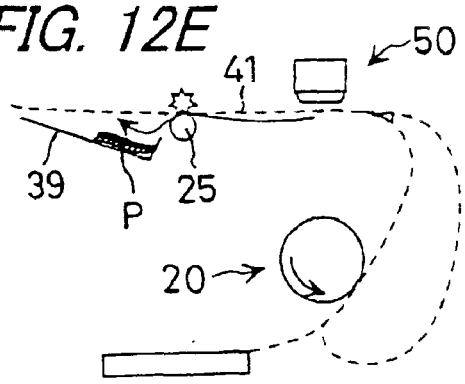
Figure 12C:
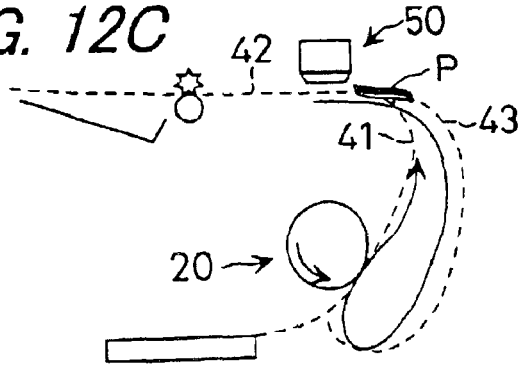

Next, in step s219, the CPU 101 reads out the back-surface color image data stored in the back-surface image storage section 105 in the order from part of the data corresponding to part of an image to be formed on the rear-end part of the recording paper P. Then, in step s220, as shown in FIG. 12C, the recording paper P is guided through the sub conveying path 43 to the main conveying path 41, and, in step s221, the flapper 56 is set in a position indicated by the solid line in FIG. 2 to provide communication between the main conveying path 41 and the discharged-paper conveying path 42, as shown in FIG. 12D, guiding the recording paper P to the discharged-paper conveying path 42.

In this way, in step s222, under the control of the CPU 101, for the second surface of the recording paper P traveling in the arrow-a direction along the discharged-paper conveying path 42, back-surface color image data is supplied, via the image processing section 106, to the driver 108 of the ink head 53*a* at a timing synchronized with the driving timing set for the conveying roller 51 (at the timing with which the rear end of the recording paper P coincides with the color image data corresponding to the rear-end part of the image). Thereupon, back-surface color image formation is performed by the second image forming section 50. That is, the image processing section 106 outputs back-surface color image data to the driver 108 in such a manner that an image is gradually formed in an order from its rear-end portion to its front-end portion on the recording paper P. Then, in step s223, under the control of the CPU 101, upon completion of the image formation based on the whole of the back-surface color image data, as shown in FIG. 12E, in step s210, the recording paper P is discharged onto the discharge tray 39 in such a manner that its surface carrying the top-surface color image faces downward, i.e., in the Face-Down manner.

Figure 13:
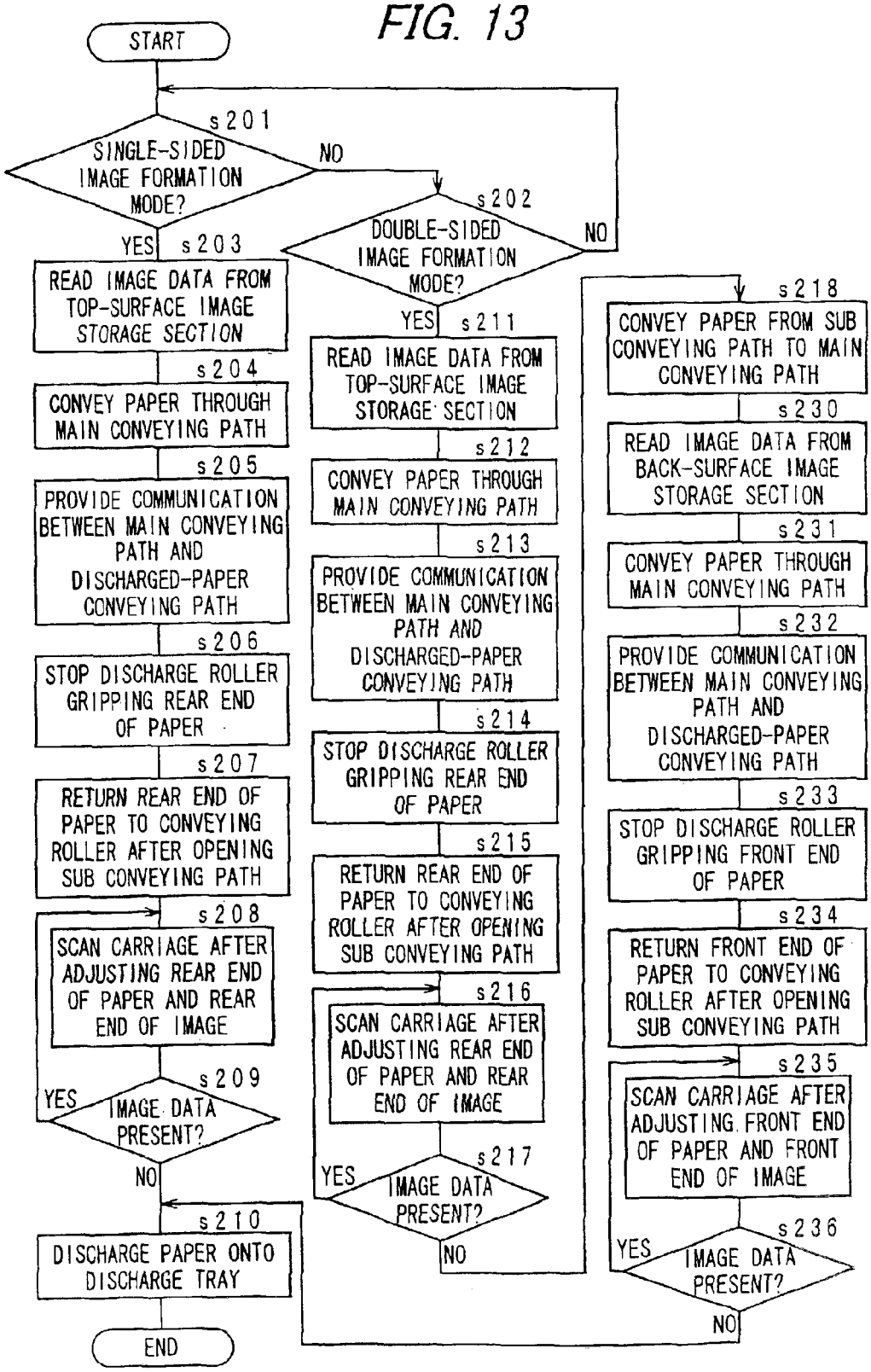
FIG. 13 is a flow chart showing another example of processing procedure performed in the digital copier, for performing color image forming operation.

In this embodiment, the back-surface color image formation is performed by moving the recording paper P in the arrow-a direction along the discharged-paper conveying path 42. Alternatively, like the top-surface color image formation, it may be performed by moving the recording paper P in the arrow-b direction along the discharged-paper conveying path 42. FIG. 13 shows a flow chart for explaining the operation.

Figure 10:
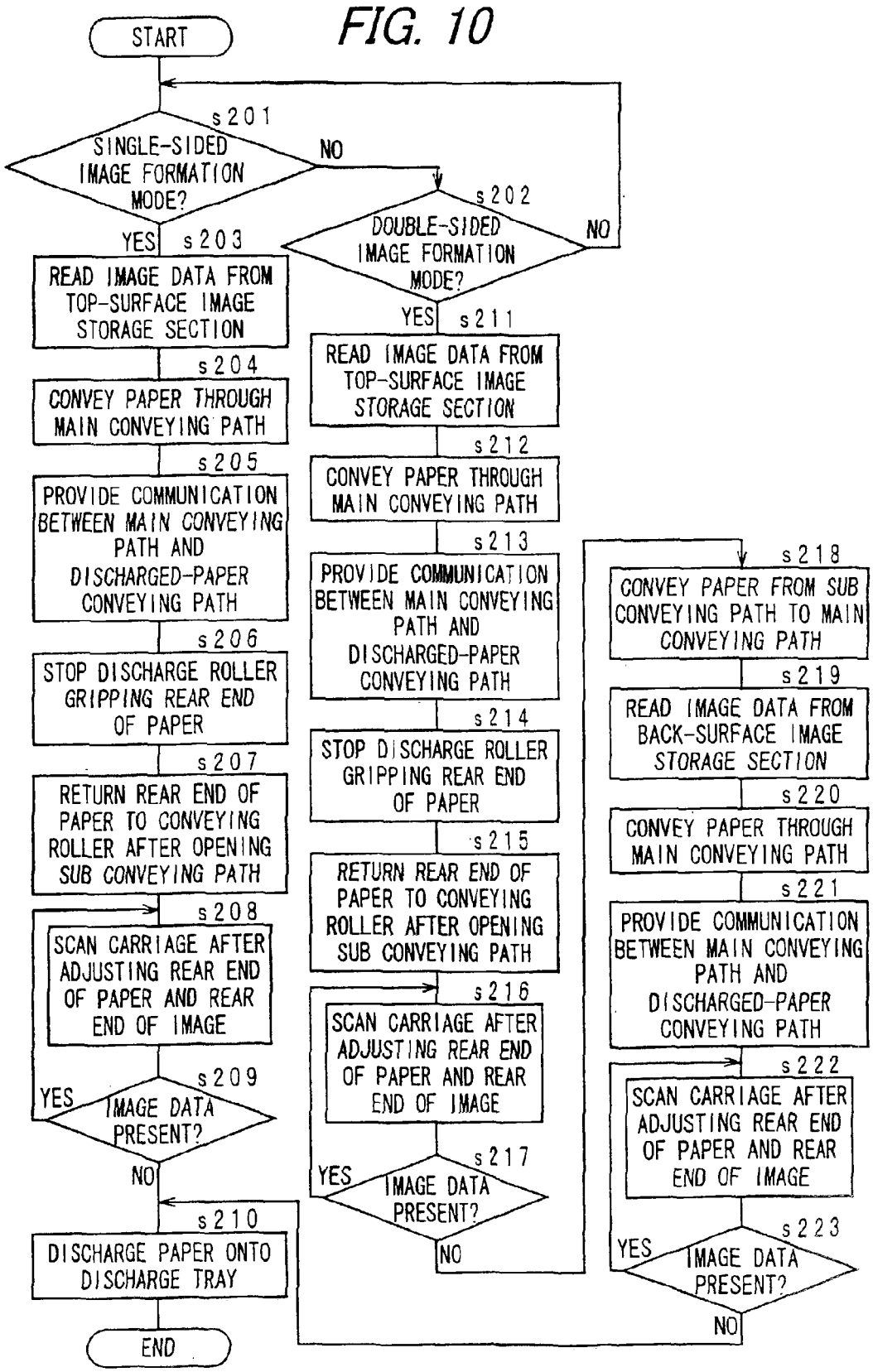
FIG. 10 is a flow chart showing the sequence of the processing procedure performed in the digital copier, for performing color image formation.
Figure 14A:
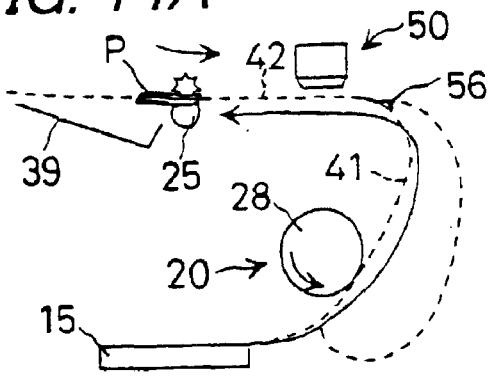
FIGS. 14A to 14F are views of assistance in explaining the path through which recording paper is conveyed, for a case where color image formation in a double-sided image formation mode is performed in the digital copier shown in FIG. 13.
Figure 14D:
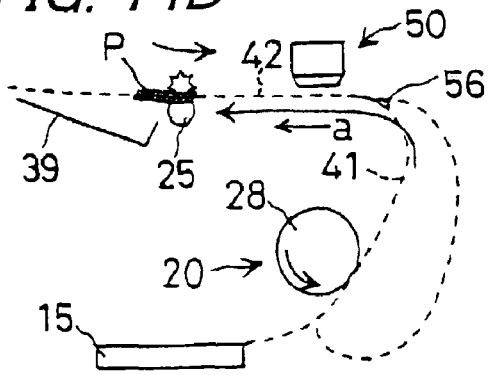
Figure 14B:
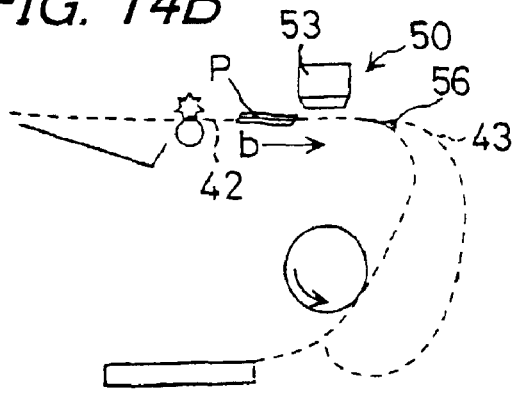
Figure 14E:
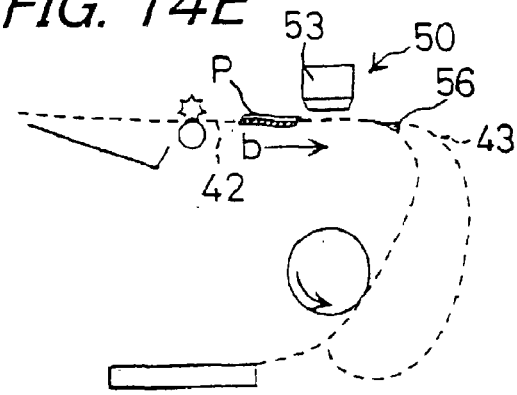
Figure 14C:
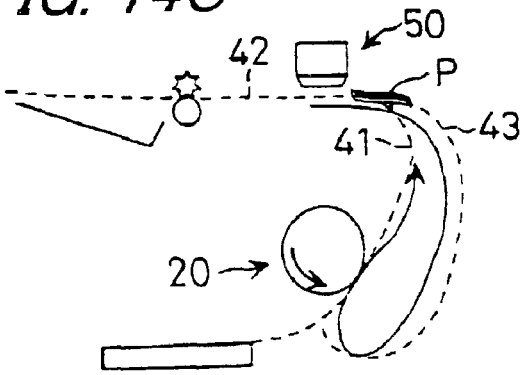

In the case of the double-sided image formation mode, as shown in the flow chart of FIG. 13, as well as FIGS. 14A and 14B, in accordance with steps s211 through s218 as illustrated in the flow chart of FIG. 10, top-surface color image formation is performed. Thereafter, in step s230, the CPU 101 reads out the back-surface color image data stored in the back-surface image storage section 105 in the order from part of the data corresponding to part of an image to be formed on the front-end part of the recording paper P. Then, in step s231, as shown in FIG. 14C, the recording paper P is guided through the sub conveying path 43 to the main conveying path 41, and, in step s232, the flapper 56 is set in a position indicated by the solid line in FIG. 2 to provide communication between the main conveying path 41 and the discharged-paper conveying path 42, guiding the recording paper P to the discharged-paper conveying path 42.

Under the control of the CPU 101, in step s233, as shown in FIG. 14D, after the recording paper P is allowed to pass through the second image forming section 50 in the arrow-a direction, the discharge roller 25 is brought to a stop, with the front end of the recording paper P kept gripped by the discharge roller 25. Subsequently, in step s234, under the control of the CPU 101, the flapper 56 is set in a position indicated by the broken line in FIG. 2 to provide communication between the discharged-paper conveying path 42 and the sub conveying path 43. In this state, as shown in FIG. 14E, the discharge roller 25 is rotated reversely until the front end of the recording paper P reaches the conveying roller 52, so that the recording paper P is conveyed in the arrow-b direction. Then, in step s235, under the control of the CPU 101, back-surface color image data is supplied, via the image processing section 106, to the driver 108 of the ink head 53*a* at a timing synchronized with the driving timing set for the conveying roller 52 (at the timing with which the front end of the recording paper P coincides with the color image data corresponding to the front-end part of the image). After making adjustments to the conveyance of the recording paper P in the arrow-b direction and to the operations of the carriage 53 and the ink head 53*a* in the second image forming section 50, color image formation is performed on the recording paper P. That is, the image processing section 106 outputs back-surface color image data to the driver 108 in such a manner that an image is gradually formed in an order from its front-end portion to its rear-end portion on the recording paper P.

Figure 14F:
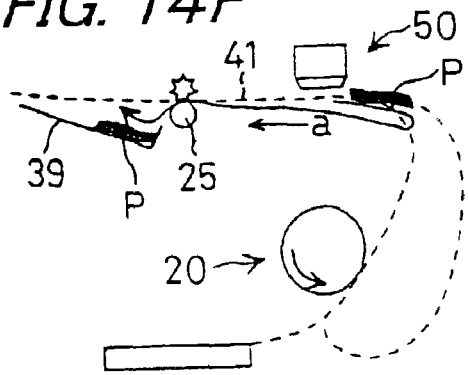

Upon completion of image formation based on the whole of the back-surface color image data instep s236, under the control of the CPU 101, in step s210, as shown in FIG. 14F, the discharge roller 25 and the conveying rollers 51, 52 are normally rotated, so that the recording paper P is conveyed in the arrow-a direction within the discharged-paper conveying path 42. Finally, the recording paper P is discharged onto the discharge tray 39 in such a manner that its surface carrying the top-surface color image faces downward, i.e., in the Face-Down manner.

Note that, during color image formation in the double-sided image formation mode, the recording paper P is subjected to top-surface color image formation in the first place, for the following reason. Even in a case where continuous images are formed onto a plurality of paper sheets, there is no need to perform collating operation with respect to the recording paper P discharged onto the discharge tray 39. Besides, in the above-described process, although black-color image data included in color image data is also subjected to the ink-jet-system image formation performed in the second image forming section 50, by adopting the same process as in a subsequently-described mixed image formation, black-color image data included in color image data can be subjected to the electrophotographic-system image formation performed in the first image forming section 20. This makes it possible to eliminate the need to provide a black-ink tank in the second image forming section 50, resulting in advantages in simplifying the structure of the second image forming section 50 and in making the carriage 53 lighter in weight.

(3) Mixed Image Formation

Mixed image formation, which is accomplished by combining the electrophotographic-system monochromatic image formation performed in the first image forming section 20 and the ink-jet-system color image formation performed in the second image forming section 50, is performed as follows. As shown in the flow charts illustrated in FIGS. 15 and 16, firstly, in steps s301 and s302, the CPU 101 judges whether image formation is performed based on the single-sided image formation mode for forming an image on one surface of the recording paper P, or on the double-sided image formation mode for forming an image on both surfaces of the recording paper P.

Figure 17A:
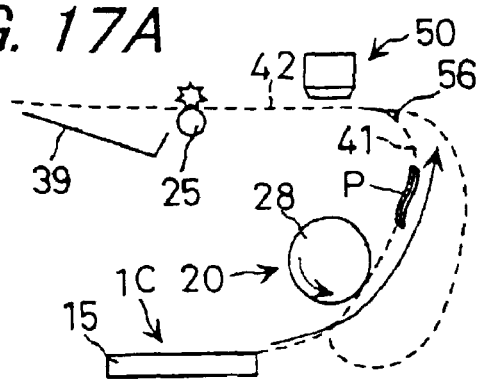
FIGS. 17A to 17E are views of assistance in explaining the path through which recording paper is conveyed, for a case where mixed image formation in a single-sided image formation mode is performed in the digital copier shown in FIG. 15.

In the case of the single-sided image formation mode, the electrophotographic-system monochromatic image formation, which is performed in the first image forming section 20 arranged on the upstream side of the recording paper P conveying path, is carried out earlier than the ink-jet-system color image formation performed in the second image forming section 50. The image formation in the first image forming section 20 is performed as follows. Firstly, in step s303, under the control of the CPU 101, top-surface monochromatic image data stored in the top-surface image storage section 104 is read out in the order from its part corresponding to part of an image to be formed on the front-end part of the recording paper P. The image data thus obtained is supplied, via the image processing section 106, to the controller 107 at a timing synchronized with the driving timing set for the resist roller 22. That is, the image processing section 106 outputs top-surface monochromatic image data to the controller 107 in such a manner that an image is gradually formed in an order from its front-end portion to its rear-end portion on the recording paper P. Thereby, in the first image forming section 20, an electrostatic latent image is formed on the surface of the photoconductive drum 28 by the LSU 30. Then, in step s304, under the control of the CPU 101, the resultant electrostatic latent image is visualized as a developer image using the developer supplied from the development unit 31. Next, in step s305, during the interval when the recording paper P fed from the paper supply unit 1C is passing through the region between the photoconductive drum 28 and the transfer unit 32, as shown in FIG. 17A, the developer image is transferred onto the recording paper P by the transfer unit 32.

Subsequently, in step s306, under the control of the CPU 101, the fixation unit 23 applies heat and pressure to the recording paper P, whereupon the developer image is fixed onto the recording paper P. Then, in step s307, the flapper 56 is set in a position indicated by the solid line in FIG. 2 to provide communication between the main conveying path 41 and the discharged-paper conveying path 42, permitting the recording paper P to travel in the arrow-a direction so as to pass through the second image forming section 50, as shown in FIG. 17B, in step s308. Thereafter, the discharge roller 25 is driven to stop rotating, with the recording paper P kept gripped by the discharge roller 25. In this state, in step s309, under the control of the CPU 101, the top-surface color image data stored in the top-surface image storage section 104 is read out in the order from its part corresponding to part of an image formed on the rear-end part of the recording paper P, and, in step s310, the flapper 56 is set in a position indicated by the broken line in FIG. 2 to provide communication between the discharged-paper conveying path 42 and the sub conveying path 43. Then, the conveying rollers 51, 52 and the discharge roller 25 are rotated reversely, so that the recording paper P is conveyed in the arrow-b direction, and is then guided through the sub conveying path 43 to the main conveying path 41, as shown in FIG. 17C.

Figure 17D:
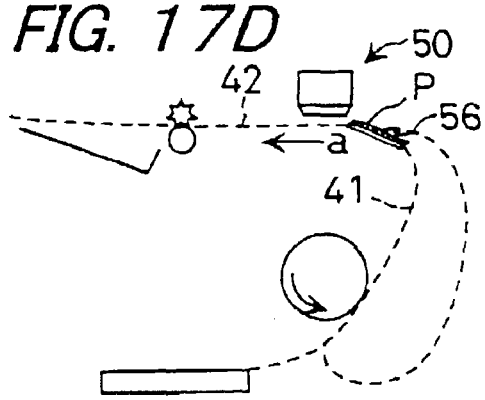
Figure 17B:
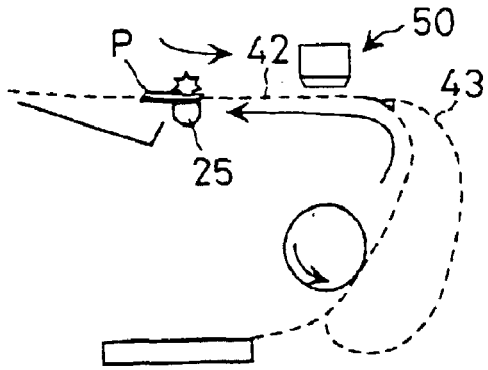
Figure 17E:
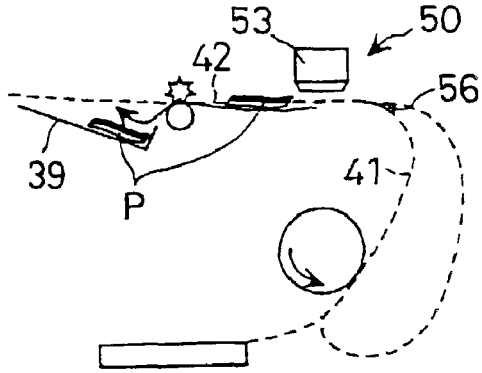
Figure 17C:
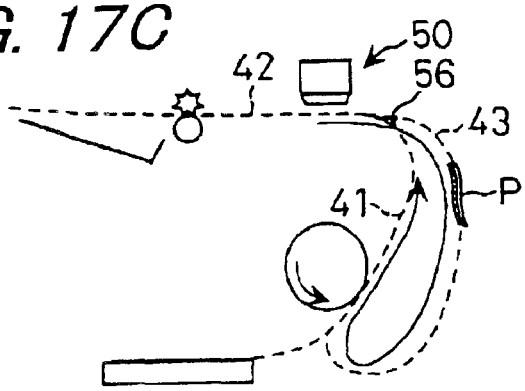

After that, in step s311, under the control of the CPU 101, the flapper 56 is set in a position indicated by the solid line in FIG. 2 to provide communication between the main conveying path 41 and the discharged-paper conveying path 42, as shown in FIG. 17D, permitting the recording paper P to be guided to the discharged-paper conveying path 42. Then, in step s312, top-surface color image data is supplied, via the image processing section 106, to the driver 108 of the ink head 53*a* at a timing synchronized with the driving timing set for the conveying roller 52 (at the timing with which the rear end of the recording paper P coincides with the color image data corresponding to the rear-end part of the image). Thereupon, for the first surface of the recording paper P traveling in the arrow-a direction along the discharged-paper conveying path 42, top-surface color image formation is performed by the second image forming section 50. That is, the image processing section 106 outputs top-surface color image data to the driver 108 in such a manner that an image is gradually formed in an order from its rear-end portion to its front-end portion on the recording paper P. Upon completion of image formation based on the whole of the top-surface color image data in step 313, as shown in FIG. 17E, in step 314, under the control of the CPU 101, the recording paper P is discharged onto the discharge tray 39 in such a manner that its surface carrying the top-surface monochromatic and color images faces upward, i.e., in the Face-Up manner.

In this way, also in the single-sided image formation mode, the recording paper P is conveyed along, in addition to the main conveying path 41 and the discharged-paper conveying path 42, the sub conveying path 43. With such a configuration, even if the first and second image forming sections 20 and 50 are so arranged as to form images on the mutually-different surfaces of the recording paper P passing through the discharged-paper conveying path 42 via the main conveying path 41, monochromatic image formation undertaken by the first image forming section 20 and color image formation undertaken by the second image forming section 50 can be performed on the same surface of the recording paper P.

Note that, in the above-described example, the recording paper P is discharged onto the discharge tray 39 in the Face-Up manner to shorten the time required for image formation. Alternatively, in order for the recording paper P to be discharged onto the discharge tray 39 in the Face-Down manner to eliminate the need for collating operation required to form continuous images on a plurality of recording paper sheets P, the recording paper P having undergone monochromatic- and color-image formation is guided to the sub conveying path 43 once again, and then passes through the main conveying path 41 and the discharged-paper conveying path 42 to be discharged.

Figure 16:
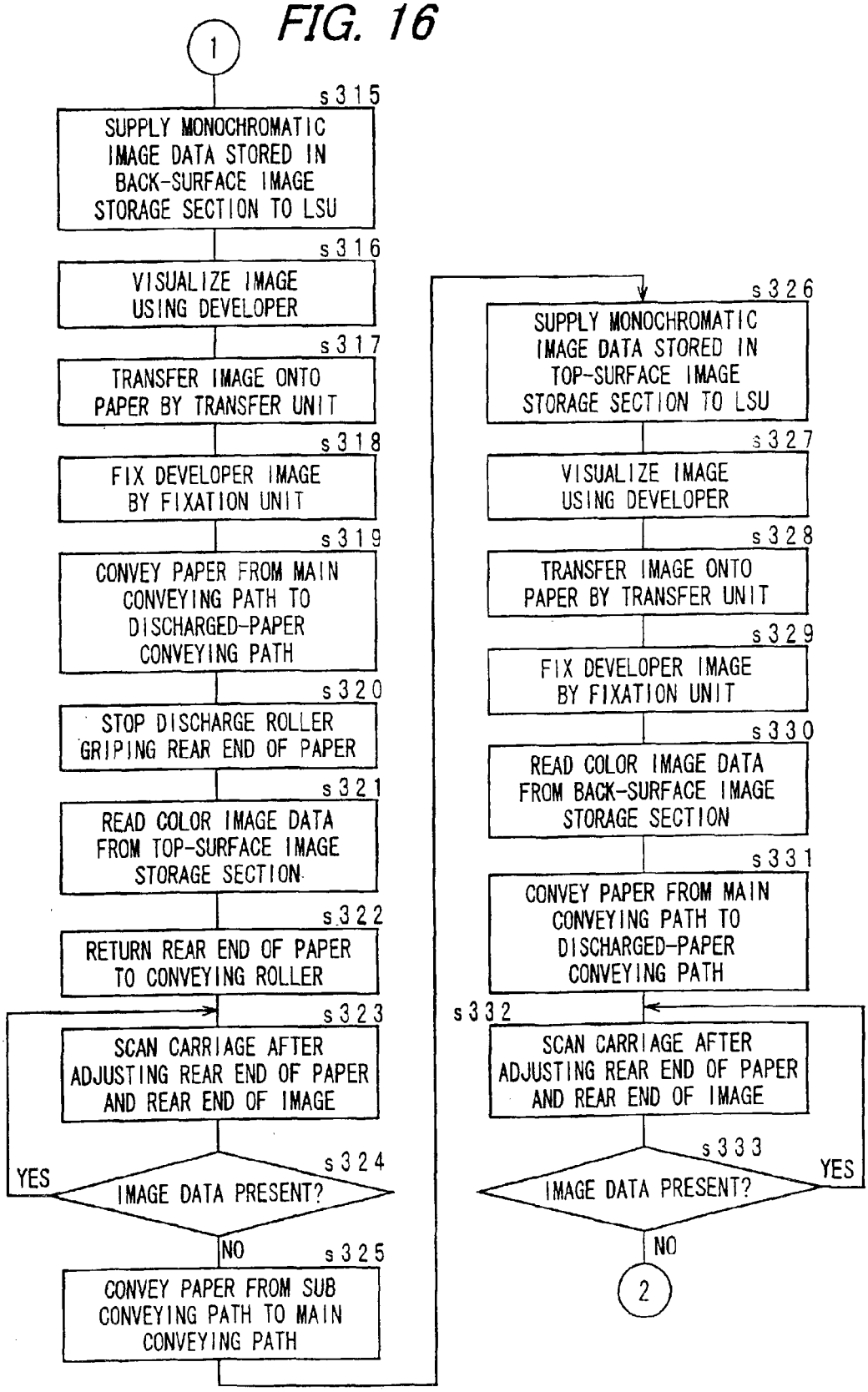
FIG. 16 is a flow chart showing the sequence of the processing procedure performed in the digital copier, for performing mixed image formation in a double-sided image formation mode.
Figure 18A:
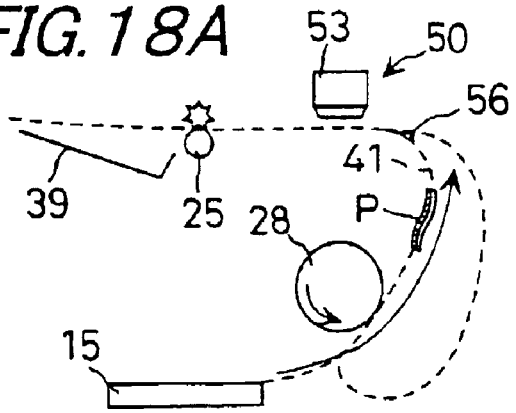
FIGS. 18A to 18F are views of assistance in explaining the path through which recording paper is conveyed, for a case where mixed image formation in a double-sided image formation mode is performed in the digital copier shown in FIG. 16.

As shown in the flow chart of FIG. 16, in the double-sided image formation mode, in step 315, the CPU 101 reads out the back-surface monochromatic image data stored in the back-surface image storage section 105 in the order from part of the data corresponding to part of an image to be formed on the front-end part of the recording paper P. The image data thus obtained is supplied, via the image processing section 106, to the first image forming section 20. Then, in steps s316 through s319, in accordance with the same process steps as in steps s304 through 307, back-surface monochromatic image formation is performed on the first surface of the recording paper P and then, as shown in FIG. 18A, the recording paper P, now carrying a developer image on its first surface as a result of the operation performed by the first image forming section 20, is guided to the discharged-paper conveying path 42. That is, the image processing section 106 outputs back-surface monochromatic image data to the controller 107 in such a manner that an image is gradually formed in an order from its rear-end portion to its front-end portion on the recording paper P. Then, in step 320, under the control of the CPU 101, as shown in FIG. 17B, the discharge roller 25 is driven to stop rotating, with the recording paper P having passed through the second image forming section 50 kept gripped by the discharge roller 25. Thereafter, in step s321, the top-surface color image data stored in the top-surface image storage section 104 is read out in the order from its part corresponding to part of an image formed on the rear-end part of the recording paper P.

Subsequently, in step 322, under the control of the CPU 101, the flapper 56 is set in a position indicated by the broken line in FIG. 2 to provide communication between the discharged-paper conveying path 42 and the sub conveying path 43. In this state, as shown in FIG. 18C, the discharge roller 25 is rotated reversely until the rear end of the recording paper P reaches the conveying roller 52, so that the recording paper P is conveyed in the arrow-b direction. Then, in steps s323 and s324, top-surface color image data is supplied, via the image processing section 106, to the driver 108 of the ink head 53*a* at a timing synchronized with the driving timing set for the conveying roller 52 (at the timing with which the rear end of the recording paper P coincides with the color image data corresponding to the rear-end part of the image). After making adjustments to the conveyance of the recording paper P in the arrow-b direction and to the operations of the carriage 53 and the ink head 53*a* in the second image forming section 50, for the second surface of the recording paper P, image formation is performed based on the whole of the top-surface color image data. That is, the image processing section 106 outputs top-surface color image data to the driver 108 in such a manner that an image is gradually formed in an order from its rear-end portion to its front-end portion on the recording paper P.

Figure 18D:
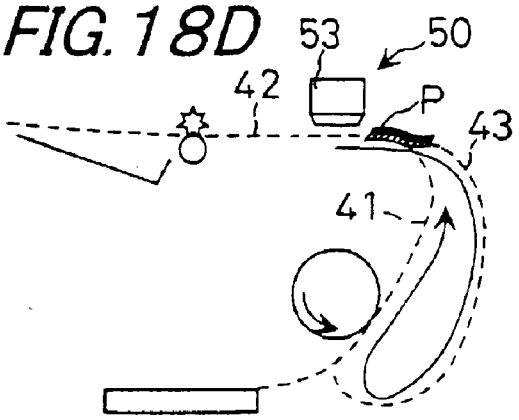
Figure 18B:
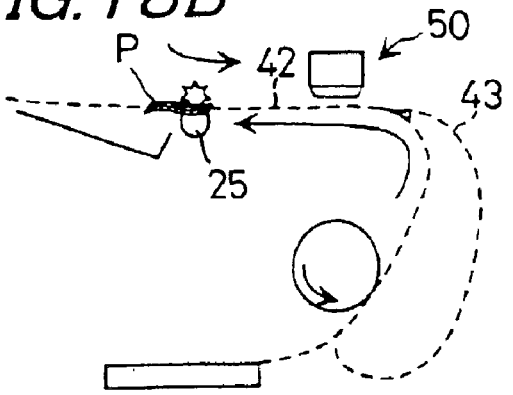
Figure 18E:
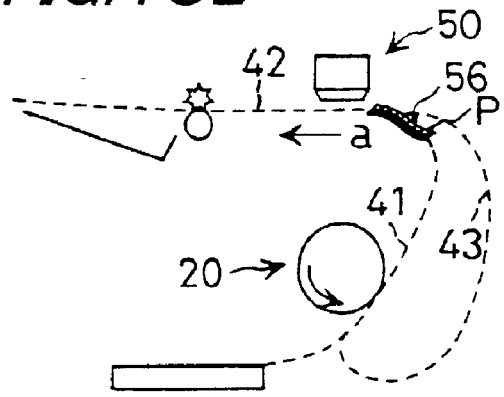
Figure 18C:
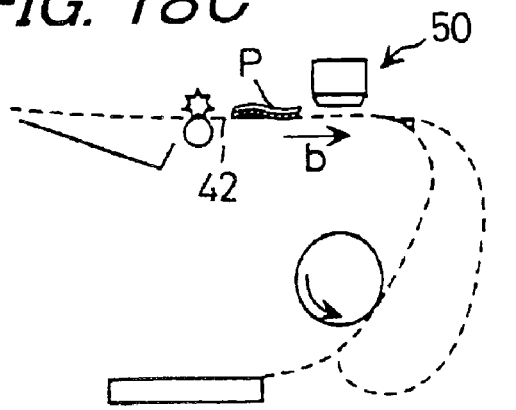

In step s325, under the control of the CPU 101, as shown in FIG. 18D, the recording paper P carrying both of the back-surface monochromatic image and top-surface color image is guided through the sub conveying path 43 to the main conveying path 41, and, in step s326, the top-surface monochromatic image data stored in the top-surface image storage section 104 is read out in the order from its part corresponding to part of an image formed on the rear-end part of the recording paper P. The image data thus obtained is supplied, via the image processing section 106, to the first image forming section 20 at a timing synchronized with the driving timing set for the resist roller 22 and, in steps s327 through s329, in accordance with the same process steps as in steps s304 through 306, top-surface monochromatic image formation is performed on the second surface of the recording paper P). That is, the image processing section 106 outputs top-surface monochromatic image data to the controller 107 in such a manner that an image is gradually formed in an order from its rear-end portion to its front-end portion on the recording paper P.

Figure 18F:
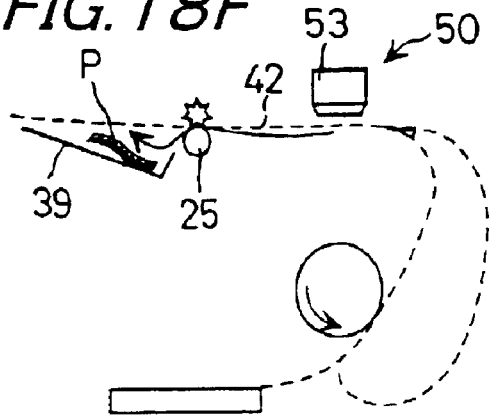

Further, in step s330, the CPU reads out the back-surface color image data stored in the back-surface image storage section 105 in the order from part of the data corresponding to part of an image formed on the rear-end part of the recording paper P, and, in steps 331, the flapper 56 is set in a position indicated by the solid line in FIG. 2 to provide communication between the main conveying path 41 and the discharged-paper conveying path 42, as shown in FIG. 17E, permitting the recording paper P to be guided to the discharged-paper conveying path 42. Then, in step s332, the back-surface color image data is supplied, via the image processing section 106, to the driver 108 of the ink head 53*a* at a timing synchronized with the driving timing set for the conveying roller 51 (at the timing with which the rear end of the recording paper P coincides with the color image data corresponding to the rear-end part of the image). Thereupon, for the first surface of the recording paper P traveling in the arrow-a direction along the discharged-paper conveying path 42, back-surface color image formation is performed by the second image forming section 50. That is, the image processing section 106 outputs back-surface color image data to the driver 108 in such a manner that an image is gradually formed in an order from its rear-end portion to its front-end portion on the recording paper P. Upon completion of image formation based on the whole of the back-surface color image data in step 333, as shown in FIG. 18F, in step 314, under the control of the CPU 101, the recording paper P is discharged onto the discharge tray 39 in such a manner that its surface carrying the top-surface image faces downward, i.e., in the Face-Down manner.

Figure 19:
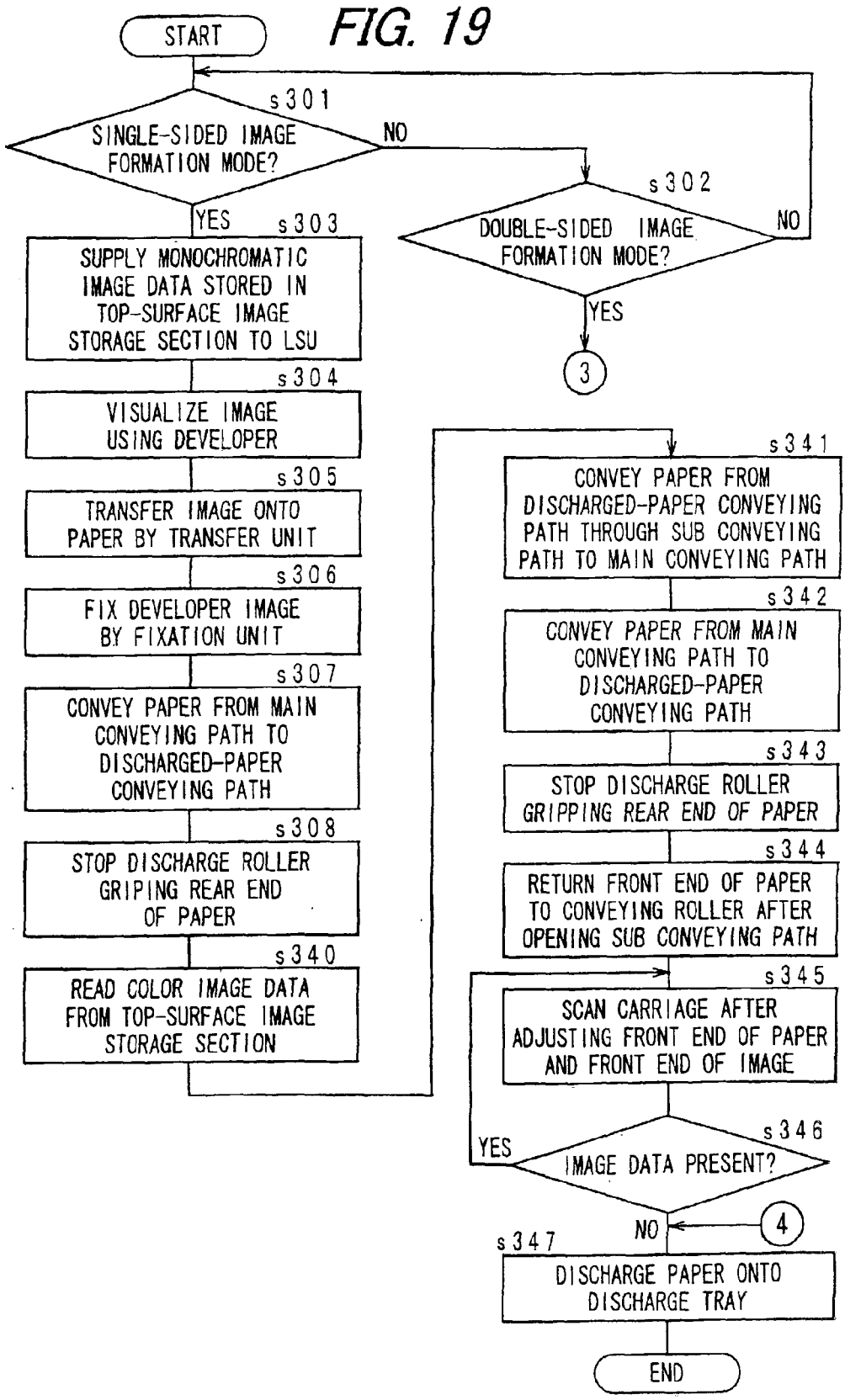
FIG. 19 is a flow chart showing another example of processing procedure performed in the digital copier, for performing mixed image forming operation in a single-sided image formation mode.
Figure 20:
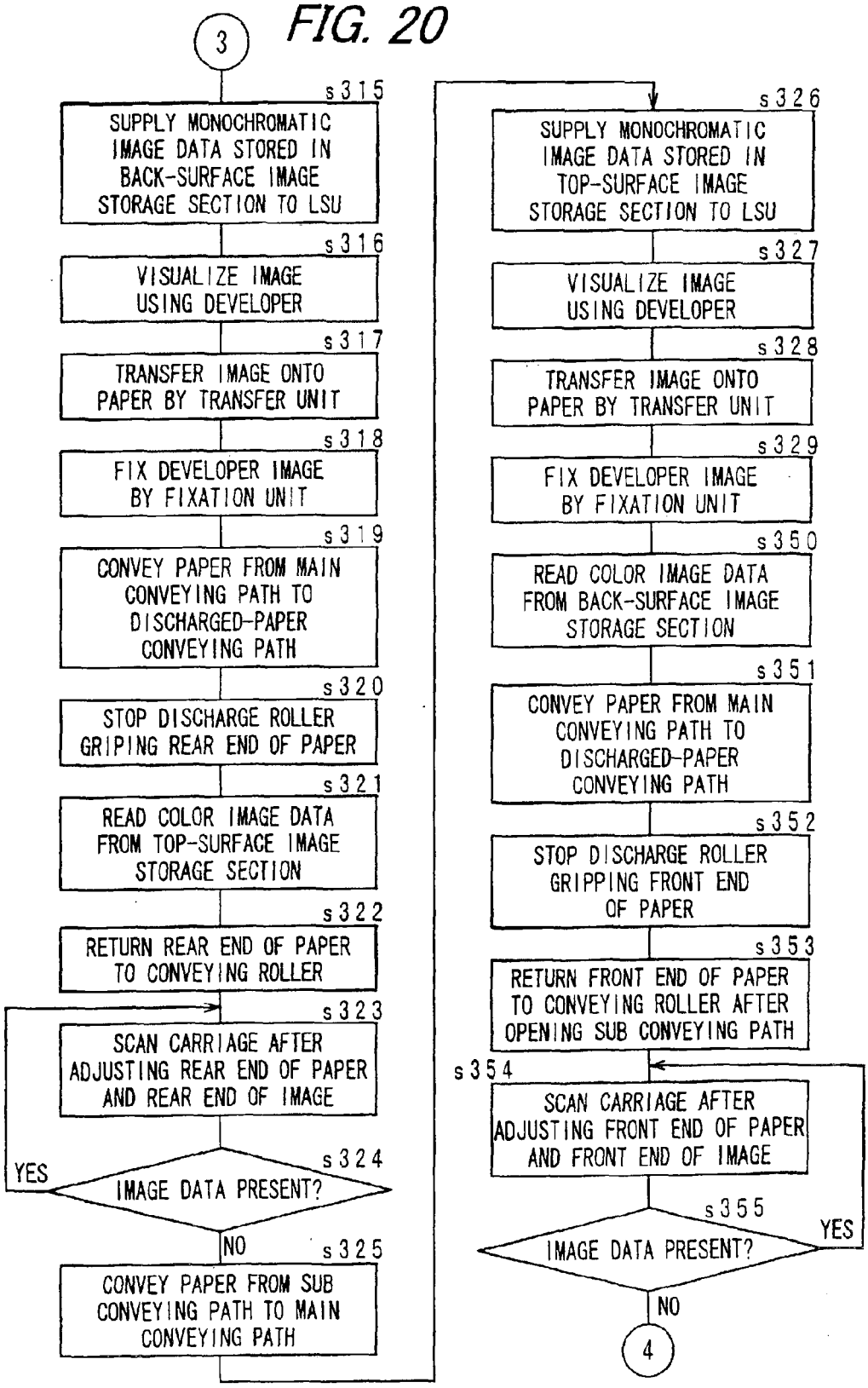
FIG. 20 is a flow chart showing another example of processing procedure performed in the digital copier, for performing mixed image forming operation in a double-sided image formation mode.

In this embodiment, the top-surface color image formation is performed by moving the recording paper P in the arrow-a direction along the discharged-paper conveying path 42. Alternatively, it may be performed by moving the recording paper P in the arrow-b direction along the discharged-paper conveying path 42. FIGS. 19 and 20 respectively show a flow chart for explaining the operation.

Figure 15:
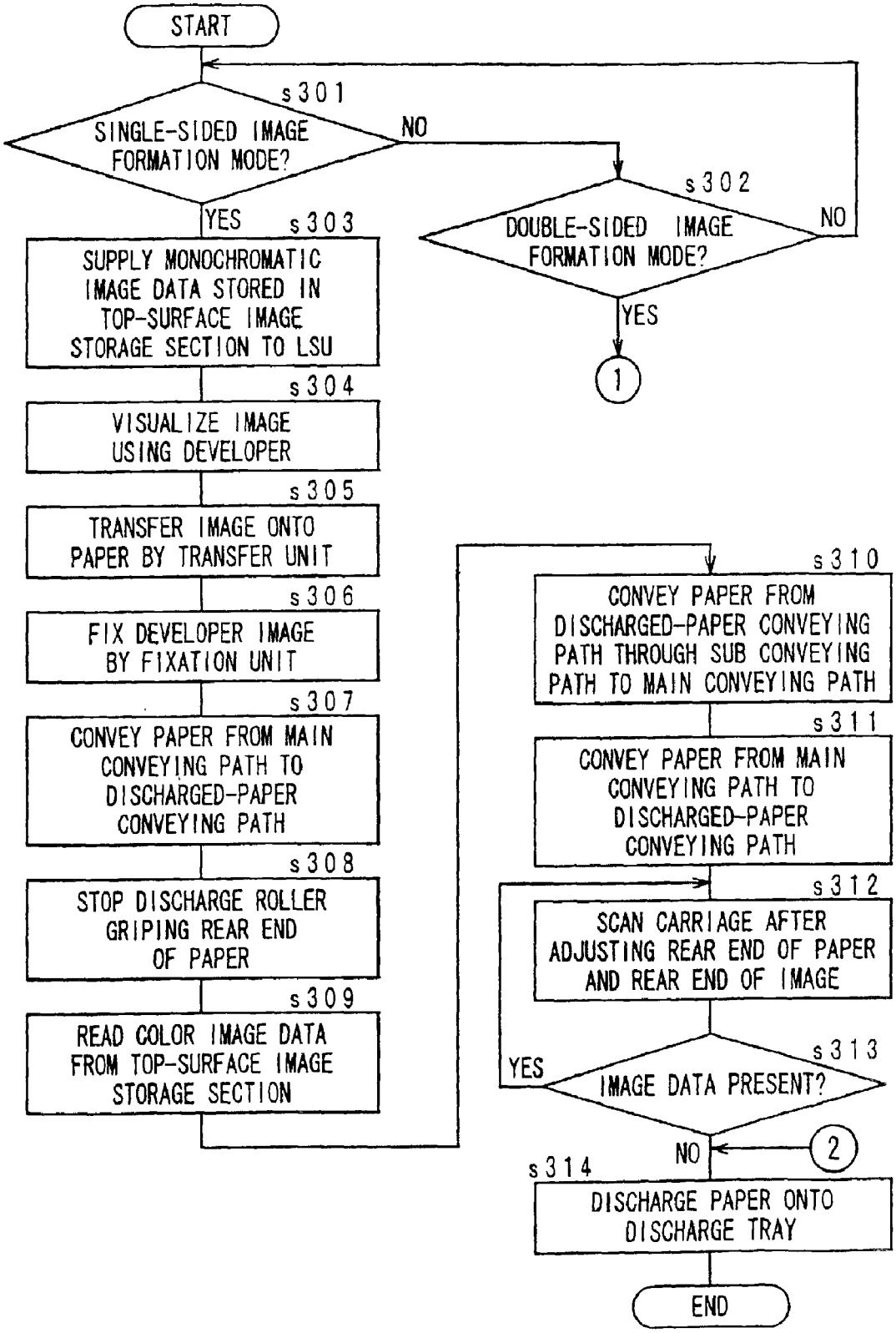
FIG. 15 is a flow chart showing the sequence of the processing procedure performed in the digital copier, for performing mixed image formation in a single-sided image formation mode.
Figure 21A:
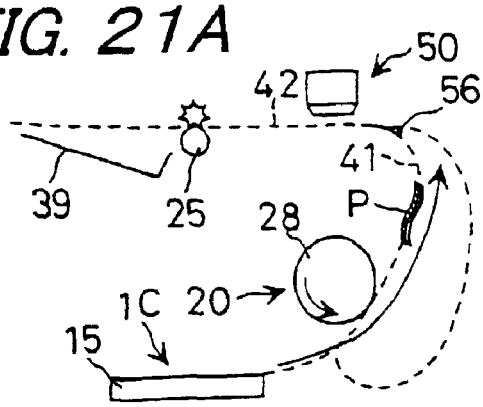
FIGS. 21A to 21F are views of assistance in explaining the path through which recording paper is conveyed, for a case where mixed image formation in a single-sided image formation mode is performed in the digital copier shown in FIG. 19.
Figure 21D:
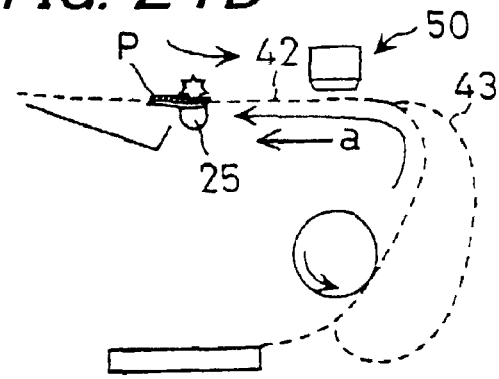
Figure 21B:
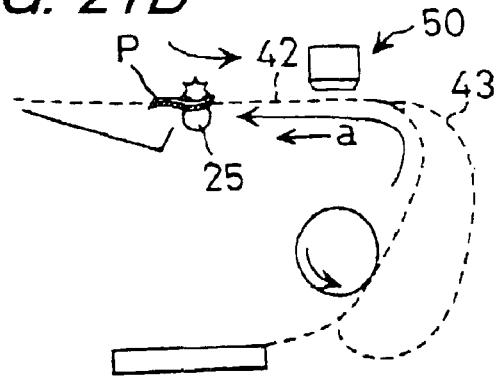
Figure 21E:
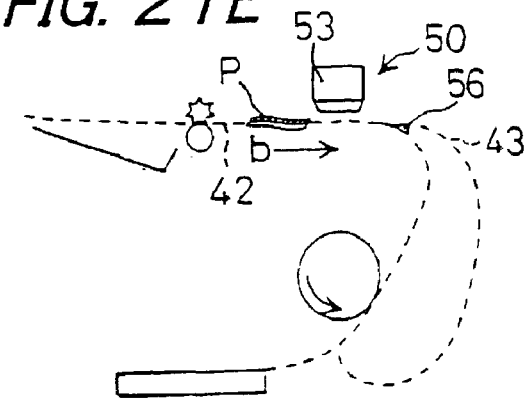
Figure 21C:
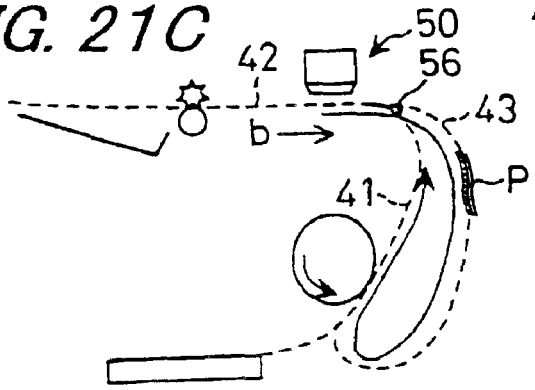

In the case of the single-sided image formation mode, as shown in the flow chart of FIG. 19, as well as FIGS. 21A and 21B, under the control of the CPU 101, in accordance with steps s303 through s308 as illustrated in the flow chart of FIG. 15, top-surface monochromatic image formation is performed, and the discharge roller 25 is driven to stop rotating, with the recording paper P kept gripped by the discharge roller 25. Thereafter, in step s340, the CPU 101 reads out the top-surface color image data stored in the top-surface image storage section 104 in the order from part of the data corresponding to part of an image to be formed on the front-end part of the recording paper P. Then, in step s341, the flapper 56 is set in a position indicated by the broken line in FIG. 2 to provide communication between the main conveying path 41 and the sub conveying path 43. As shown in FIG. 21C, under the control of the CPU 101, the conveying rollers 51, 52 and the discharge roller 25 are rotated reversely, so that the recording paper P is conveyed in the arrow-b direction, and is then guided through the sub conveying path 43 to the main conveying path 41. After that, in step s342, under the control of the CPU 101, the flapper 56 is set in a position indicated by the solid line in FIG. 2 to provide communication between the main conveying path 41 and the discharged-paper conveying path 42, permitting the recording paper P to be guided, through the first image forming section 20, to the discharged-paper conveying path 42.

Under the control of the CPU 101, in step s343, as shown in FIG. 21D, after the recording paper P is allowed to pass through the second image forming section 50 in the arrow-a direction, the discharge roller 25 is brought to a stop, with the front end of the recording paper P kept gripped by the discharge roller 25. Subsequently, in step s344, under the control of the CPU 101, the flapper 56 is set in a position indicated by the broken line in FIG. 2 to provide communication between the discharged-paper conveying path 42 and the sub conveying path 43. In this state, as shown in FIG. 21E, the discharge roller 25 is rotated reversely until the front end of the recording paper P reaches the conveying roller 52, so that the recording paper P is conveyed in the arrow-b direction. Then, in step s345, under the control of the CPU 101, top-surface color image data is supplied, via the image processing section 106, to the driver 108 of the ink head 53*a* at a timing synchronized with the driving timing set for the conveying roller 52 (at the timing with which the front end of the recording paper P coincides with the color image data corresponding to the front-end part of the image). After making adjustments to the conveyance of the recording paper P in the arrow-b direction and to the operations of the carriage 53 and the ink head 53*a* in the second image forming section 50, color image formation is performed on the recording paper P. That is, the image processing section 106 outputs back-surface color image data to the driver 108 in such a manner that an image is gradually formed in an order from its front-end portion to its rear-end portion on the recording paper P.

Figure 21F:
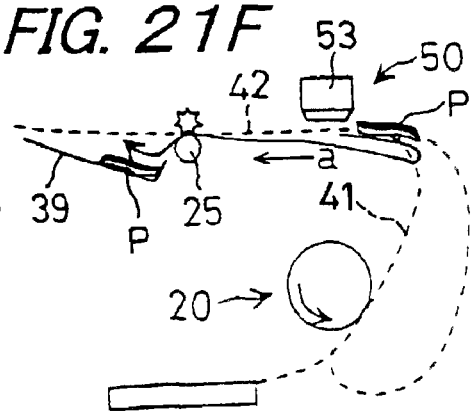

Upon completion of image formation based on the whole of the top-surface color image data in step s346, under the control of the CPU 101, in step s347, as shown in FIG. 21F, the discharge roller 25 and the conveying rollers 51, 52 are normally rotated, so that the recording paper P is conveyed in the arrow-a direction within the discharged-paper conveying path 42. Finally, the recording paper P is discharged onto the discharge tray 39 in such a manner that its surface carrying the top-surface monochromatic and color images faces upward, i.e., in the Face-Up manner.

In the case of the double-sided image formation mode, as shown in the flow chart of FIG. 20, as well as FIGS. 22A to 22D, in accordance with steps s315 through s329 as illustrated in the flow chart of FIG. 16, top- and back-surface monochromatic image formation and top-surface color image formation are performed. Thereafter, in step s350, the CPU 101 reads out the back-surface color image data stored in the back-surface image storage section 105 in the, order from part of the data corresponding to part of an image to be formed on the front-end part of the recording paper P. Then, in step s351, the recording paper P is guided through the sub conveying path 43 to the main conveying path 4l, and the flapper 56 is set in a position indicated by the solid line in FIG. 2 to provide communication between the main conveying path 41 and the discharged-paper conveying path 42, guiding the recording paper P to the discharged-paper conveying path 42.

Figure 22A:
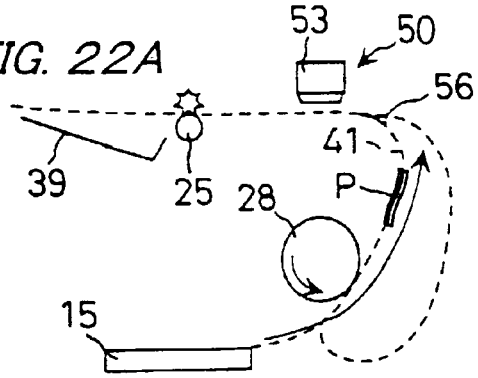
FIGS. 22A to 22G are views of assistance in explaining the path through which recording paper is conveyed, for a case where mixed image formation in a double-sided image formation mode is performed in the digital copier shown in FIG. 20.
Figure 22B:
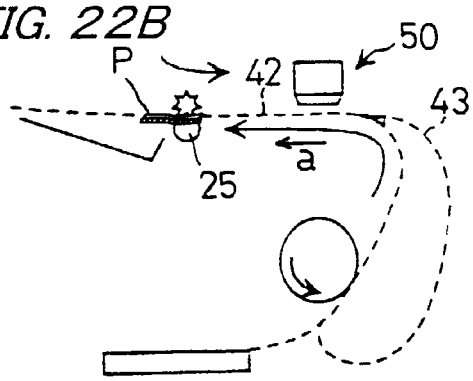
Figure 22C:
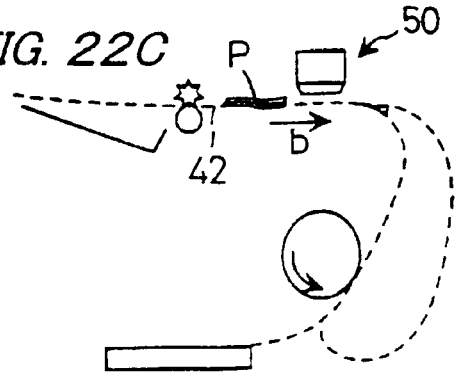
Figure 22D:
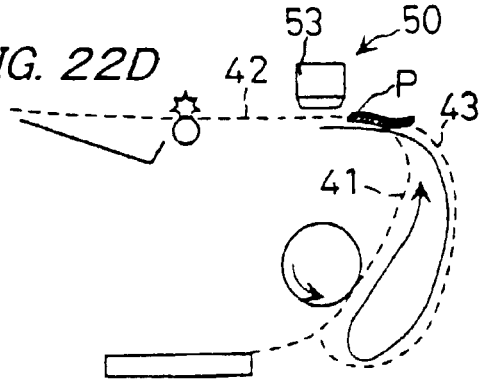
Figure 22E:
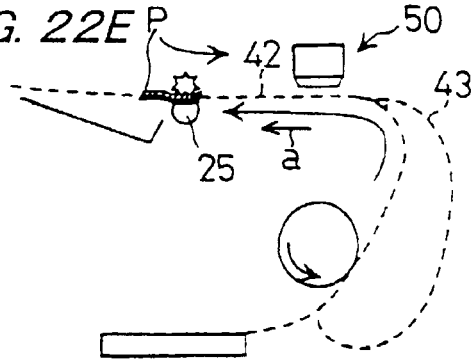
Figure 22F:
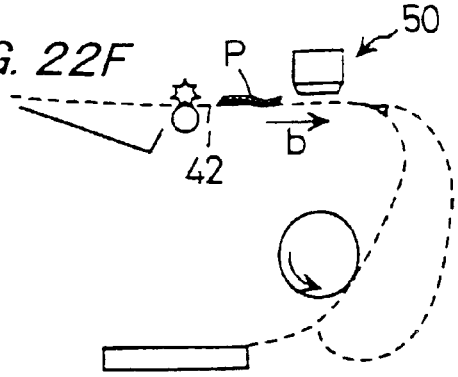

Under the control of the CPU 101, in step s352, as shown in FIG. 22E, after the recording paper P is allowed to pass through the second image forming section 50 in the arrow-a direction, the discharge roller 25 is driven to stop rotating, with the front end of the recording paper P kept gripped by the discharge roller 25. Subsequently, in step s353, under the control of the CPU 101, the flapper 56 is set in a position indicated by the broken line in FIG. 2 to provide communication between the discharged-paper conveying path 42 and the sub conveying path 43. In this state, as shown in FIG. 22F, the discharge roller 25 is rotated reversely until the front end of the recording paper P reaches the conveying roller 52, so that the recording paper P is conveyed in the arrow-b direction. Then, in step s354, under the control of the CPU 101, back-surface color image data is supplied, via the image processing section 106, to the driver 108 of the ink head 53*a* at a timing synchronized with the driving timing set for the conveying roller 52 (at the timing with which the front end of the recording paper P coincides with the color image data corresponding to the front-end part of the image). After making adjustments to the conveyance of the recording paper P in the arrow-b direction and to the operations of the carriage 53 and the ink head 53*a* in the second image forming section 50, color image formation is performed on the recording paper P. That is, the image processing section 106 outputs back-surface color image data to the driver 108 in such a manner that an image is gradually formed in an order from its front-end portion to its rear-end portion on the recording paper P.

Figure 22G:
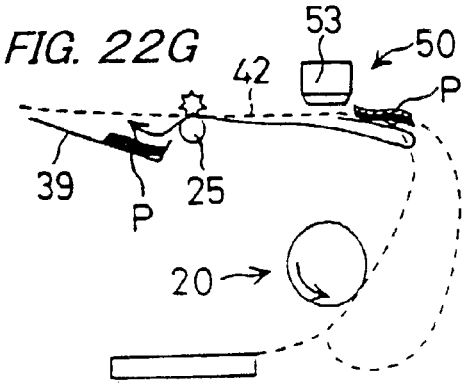

Upon completion of image formation based on the whole of the back-surface color image data instep s355, under the control of the CPU 101, in step s347, as shown in FIG. 22G, the discharge roller 25 and the conveying rollers 51, 52 are normally rotated, so that the recording paper P is conveyed in the arrow-a direction within the discharged-paper conveying path 42. Finally, the recording paper P is discharged onto the discharge tray 39 in such a manner that its surface carrying the top-surface monochromatic and color images faces downward, i.e., in the Face-Down manner.

As described heretofore, in the digital copier 1 of the embodiment under discussion, monochromatic image data and color image data can be supplied to the first and second image forming sections 20 and 50 at a desired timing and in a desired state, in conformity with the recording-paper P conveying path that differs according to whether a to-be-formed image is a monochromatic image, a color image, or a mixed image, and according to whether the mode is the single-sided image formation mode or the double-sided image formation mode.

That is, in the first image forming section 20 for performing monochromatic image formation based on the electrophotographic system, the recording paper sheets P are conveyed continuously at a constant speed, whereas in the second image forming section 50 for performing color image formation based on the ink-jet system, the recording paper sheets P are conveyed intermittently. Thus, the speed at which the recording paper P is conveyed must be changed according to whether an image to be formed is a monochromatic image or a color image. Furthermore, due care needs to be taken as to the arrangement distance between the fixation unit 23 included in the first image forming section 20 and the second image forming section 50. Specifically, if the fixation unit 23 and the second image forming section 50 are so arranged that the rear-end part of the recording paper P, which is being subjected to the ink-jet-system image formation in the second image forming section 50, is located within the fixation unit 23, it is inevitable that the rear-end part of the recording paper P is intermittently conveyed within the fixation unit 23. Thus, during intermittent halts, the portion of the recording paper P located within the fixation unit 23 is overheated, resulting in a developer image having already been formed on that portion being offset with respect to the fixation roller, or resulting in discoloration of the recording paper P.

In light of the foregoing, where ink-jet-system image formation is performed in the second image forming section 50, after being conveyed to the discharge roller 25, the recording paper P is reversed in its conveying direction, and color image formation is performed during the interval when the recording paper P is passing through the second image forming section 50 in a direction reverse to the normal conveying direction. This makes it possible to shorten the distance between the fixation unit 23 and the second image forming section 50 without causing an offset of a developer image and discoloration of the recording paper P. As a result, the digital copier 1 as a whole can be made compact.

Moreover, the recording paper P is conveyed at a highest speed while no image formation is performed thereon; is conveyed at a predetermined speed while undergoing monochromatic image formation in the first image forming section 20; and is conveyed at a lowest speed while undergoing color image formation in the second image forming section 50. This makes it possible to enhance the image formation efficiency, in particular, the time required for mixed image formation can be shortened.

Further, by arranging a heat-dissipating plate 57 of the fixation unit 23 in close proximity to or intimate contact with a conveying guide 42*a* of the-discharged-paper conveying path 42 along which the second image forming section 50 is arranged, or by designing the heat-dissipating plate 57 to serve also as the conveying guide 42*a*, it is possible to facilitate drying of the ink ejected onto the recording paper P during the ink-jet-system image formation performed by the second image forming section 50.

By virtue of such advantages, the digital copier 1 of the embodiment is capable of supplying monochromatic and color image data to the first and second image forming sections 20 and 50 in a manner suited for the arrangement status of the first and second image forming sections 20 and 50, which is so determined as to reduce the length of the conveying path to the utmost in order to achieve speeding-up of image formation and miniaturization of the entire configuration. As a result, the image reproducibility can be enhanced.

Further, the timing with which monochromatic image data is fed to the LSU 30 of the first image forming section 20, as in a typical electrophotographic-system image forming section, coincides with the driving timing set for the resist roller 22 which guides the recording paper P into the first image forming section 20. On the other hand, the timing with which color image data is fed to the ink head 53*a* of the second image forming section 50 coincides with the driving timing set for the conveying rollers 51 and 52 which guide the recording paper P into the second image forming section 50. This makes it possible to supply monochromatic and color image data to the first and second image forming sections 20 and 50 at an appropriate timing, in conformity with the recording-paper P conveyance status that differs according to whether a to-be-formed image is a monochromatic image, a color image, or a mixed image, and according to whether the mode is the single-sided image formation mode or the double-sided image formation mode. Thus, monochromatic and color images can be formed at appropriate positions on the recording paper P, so that the image reproducibility is enhanced.

Note that, in the digital copier 1 of the embodiment, various operations are selectively performed in accordance with detected judgment results, i.e. whether an image of an original is a monochromatic image, a color image, or a mixed image. Alternatively, a common operation may be performed irrespective of whether an image of an original is a monochromatic image, a color image, or a mixed image. In this case, judgment is made only as to whether the mode is the single-sided image formation mode or the double-sided image formation mode. As a result, the image forming operation can be simplified.

Moreover, the recording paper P undergoes deformation while being heated and pressurized by the fixation unit 23. In this connection, since the second image forming section 50 is so designed that the recording paper P having passed through the fixation unit 23 is subjected to the ink-jet-system image formation, during the mixed-image forming operation in particular, if deformation takes place in the recording paper P onto which a monochromatic image is formed by the first image forming section 20, there occurs a disparity in size between the color image formed by the second image forming section 50 and the monochromatic image, resulting in difference between the two images. As a result, the image reproducibility is deteriorated.

To avoid such a problem, during the image processing performed in the image processing section 106, monochromatic image data and color image data should preferably be subjected to enlargement or reduction process in consideration of the deformed state of the recording paper P attributed to the heating and pressurizing performed by the fixation unit 23. This makes the monochromatic image and the color image on the recording paper P conformable to each other in size during the mixed-image forming operation, so that the image reproducibility is enhanced.

Specifically, enlargement or reduction of image data can be achieved in the following ways. The length of the recording paper P, as viewed in the conveying direction, is measured on the basis of the time at which the recording paper P passes through the front and rear positions of the fixation unit 23, and the conveyance speed. Then, calculation is made to obtain the amount of deformation of the recording paper P, i.e., the difference in size between the recording paper P subjected to monochromatic image formation in the first image forming section 20 and that subjected to color image formation in the second image forming section 50. In accordance with the calculated deformation amount, the color image data is subjected to enlargement or reduction process.

Alternatively, in view of the fact that the deformation of the recording paper P results only from the heating and pressurizing performed by the fixation unit 23 and also the fact that the temperature and pressure of the fixation unit 23 are kept constant in the digital copier 1, an enlargement or reduction rate for the recording paper P having passed through the fixation unit 23 is experimentally measured in advance, and the resultant value is stored in a nonvolatile memory, such as the ROM 102, in the control unit 100. In accordance with the memory contents, the image data is subjected to enlargement or reduction process. This procedure eliminates the need to calculate the amount of deformation of the recording paper P on an mixed-image-formation basis, whereby making it possible to achieve simplification and speeding-up in the image forming operation.

In this case, enlargement or reduction of image data may also be achieved as follows. In consideration of the fact that a deformation amount varies with the size of the recording paper P and also the fact that the recording paper P passes through the fixation unit 23 twice while being subjected to mixed-image forming operation in the double-sided image formation mode, as shown in FIG. 23, the control unit 100 contains Table T1 storing the amount of deformation of the recording paper P which varies according to the size of the recording paper P and the number of passage of the fixation unit 23. With reference to Table T1, the image data is subjected to enlargement or reduction process.

Note that, in order to ensure that the monochromatic image and the color image conform to each other in size on either surface of the recording paper P, at least color image data alone needs to be subjected to enlargement or reduction process. Meanwhile, to ensure that all of the images on both surfaces of the recording paper P have uniform size, during monochromatic image formation for the second time, also monochromatic image data needs be subjected to enlargement or reduction process in accordance with the amount of deformation of the recording paper P.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a first image forming section for performing image formation based on monochromatic image data;

a second image forming section for performing image formation based on color image data, the first and second image forming sections being arranged in mutually different positions along a path for conveying recording paper; and an image processing section for outputting monochromatic image data and color image date, which have undergone image processing, to the first image forming section and the second image forming section, respectively, at individual timings, wherein the image processing section makes judgment on whether inputted image data is monochromatic image data or color image data, on the basis of a result of comparison between each of hue values, which is presented in inputted image data having undergone color separation, and a predetermined threshold value.

2. The image forming apparatus of claim 1, wherein, in the image processing section, comparison is made between each of the hue values presented in inputted image data having undergone color separation and a predetermined threshold value, and if at least one of the hue values is found to be equal to or greater than the predetermined threshold value, the inputted image data is judged as color image data.

3. The image forming apparatus of claim 1, wherein, in the image processing section, when a difference between the individual hue values, presented in inputted image data having undergone color separation, is found to be equal to or smaller than a predetermined threshold value, the inputted image data is judged as monochromatic image data.

4. An image forming apparatus comprising:

a first image forming section for performing image formation based on monochromatic image data;

a second image forming section for performing image formation based on color image data, the first and second image forming sections being arranged in mutually different positions along a path for conveying recording paper; and an image processing section for outputting monochromatic image data and color image data, which have undergone image processing, to the first image forming section and the second image forming section, respectively, at individual timings, wherein the first image forming section is disposed on one surface side of recording paper which is conveyed and the second image forming section is disposed on the other surface side of the recording paper which is conveyed, and in the second image forming section, an image is formed on recording paper having passed the second image forming section once, in a direction reverse to the conveying direction of image formation in the first image forming section, and in the image processing section in a case of mixed image formation comprising both monochromatic and color image data, a timing with which monochromatic and color image data are outputted is determined on the basis of a timing with which recording paper is conveyed toward the first and second image forming sections, and information on how an image is formed onto the recording paper.

5. The image forming apparatus of claim 4, wherein the image processing section outputs monochromatic image data to the first image forming section at a timing conforming to a driving timing set for a conveyance member, which is arranged immediately in front of the first image forming section along the recording paper conveying path.

6. The image forming apparatus of claim 4, wherein the image processing section outputs color image data to the second image forming section at a timing conforming to a driving timing set for a conveyance member, which is arranged immediately in front of or behind the second image forming section along the recording paper conveying path.

7. An image forming apparatus comprising:

a first image forming section for performing image formation based on monochromatic image data;

a second image forming section for performing image formation based on color image data, the first and second image forming sections being arranged in mutually different positions along a path for conveying recording paper; and an image processing section for successively outputting monochromatic and color image data to form a mixed image, which is obtained by combining monochromatic and color images, on both surfaces of recording paper in a following order: data on a monochromatic image to be formed on a first surface of the recording paper; data on a color image to be formed on a second surface of the recording paper; data on a monochromatic image to be formed on the second surface of the recording paper; and data on a color image to be formed on the first surface of the recording paper.

8. An image forming apparatus comprising:

a first image forming section far performing image formation based on monochromatic image data;

a second image forming section for performing image formation based on color image data, the first and second image forming sections being arranged in mutually different positions along a path for conveying recording paper; and an image processing section for outputting monochromatic image data and color image data, which have undergone image processing, to the first image forming section and the second image forming section, respectively, at individual timings, wherein, in the image processing section, a timing with which monochromatic and color image data are outputted is determined on the basis of a timing with which recording paper is conveyed toward the first and second image forming sections, and information on how an image is formed onto the recording paper; and the image processing section successively outputs monochromatic image data in such a manner that an image is gradually formed in an order from its front-end portion to its rear-end portion, as viewed on the recording paper, for first-surface image formation in a double-sided image formation mode, whereas output monochromatic image data in such a manner that an image is gradually formed in an order from its rear-end portion to its front-end portion, for second-surface image formation in the double-sided image formation mode.

9. An image forming apparatus comprising:

a first image forming section for performing image formation based on monochromatic image data;

a second image farming section for performing image formation based on color image data, the first and second image forming sections being arranged in mutually different positions along a path for conveying recording paper; and an image processing section for outputting monochromatic image data and color image data, which have undergone image processing, to the first image forming section and the second image forming section, respectively, at individual timings, wherein, in the image processing section, a timing with which monochromatic and color image data are outputted is determined on the basis of a timing with which recording paper is conveyed toward the first and second image forming sections, and information on how an image is formed onto the recording paper, and the image processing section successively outputs color image data in such a manner that an image is gradually formed in an order from its rear-end portion to its front-end portion, as viewed on the recording paper, for first-surface image formation in a double-sided image formation mode, whereas output color image data in such a manner that an image is gradually formed in an order from its front-end portion to its rear-end portion, for second-surface image formation in the double-sided image formation mode.

10. An image forming apparatus comprising:

a first image forming section for performing image formation based on monochromatic image data;

a second image farming section for performing image formation based on color image data, the first and second image forming sections being arranged in mutually different positions along a path for conveying recording paper; and an image processing section for outputting monochromatic image data or color image data, which have undergone enlargement or reduction process, to the first image forming section or the second image forming section, wherein the image processing section subjects monochromatic image data or color image data to enlargement or reduction process in accordance with a deformed stats of the recording paper, which has passed through a fixation unit for applying heat and pressure to the recording paper, in the first image forming section, storage means is provided for storing experimental data on a deformation amount of each of a plurality of recording paper sheets with varying sizes, which have passed through the fixation unit, and wherein, in the image processing section, in accordance with the size of the recording paper to be subjected to image formation and the number of passage of the fixation unit, an enlargement rate or reduction rate for monochromatic or color image data is determined with reference to the information stored in the storage means.

* * * * *